US010688336B2

(12) United States Patent
Athey et al.

(10) Patent No.: US 10,688,336 B2
(45) Date of Patent: Jun. 23, 2020

(54) CORDLESS TREADMILL

(71) Applicant: HUMAN POWERED FITNESS, INC., Las Vegas, NV (US)

(72) Inventors: Brett Athey, Newport Beach, CA (US); Franklin Shelley, Huntington Beach, CA (US)

(73) Assignee: Human Powered Fitness Inc., Las Vegas, NV (US)

( * ) Notice: Subject to any disclaimer, the term of this patent is extended or adjusted under 35 U.S.C. 154(b) by 0 days.

(21) Appl. No.: 16/112,456

(22) Filed: Aug. 24, 2018

(65) Prior Publication Data

US 2019/0054344 A1 Feb. 21, 2019

Related U.S. Application Data

(63) Continuation of application No. 15/521,270, filed as application No. PCT/US2015/056770 on Oct. 21, 2015, now Pat. No. 10,058,730.

(Continued)

(51) Int. Cl.

*A63B 22/02* (2006.01)
*A63B 71/06* (2006.01)

(Continued)

(52) U.S. Cl.

CPC ..... *A63B 22/02* (2013.01); *A63B 21/15* (2013.01); *A63B 22/0214* (2015.10);

(Continued)

(58) Field of Classification Search

CPC ..... A63B 22/02–0292

See application file for complete search history.

(56) References Cited

U.S. PATENT DOCUMENTS 759,296 A 5/1904 Morairty
767,221 A 8/1904 Hagen (Continued)

FOREIGN PATENT DOCUMENTS

CA 1118466 2/1982
CN 1946460 4/2007

(Continued)

OTHER PUBLICATIONS

"Instrumented Treadmill for Gait Analysis", Kistler Instrument Corp., http://www.h-p-cosmos.com/downloads/cos0k299080000_brochure_h-p-cosmos_gaitway_ll.pdf, accessed Dec. 30, 2013.

(Continued)

*Primary Examiner* — Jennifer Robertson

(74) *Attorney, Agent, or Firm* — Knobbe Martens Olson & Bear LLP

(57) ABSTRACT

A cordless treadmill includes a deck assembly including a frame, a belt system, an incline adjustment system, and a generator system; and a display assembly that supports an electronic display device above the deck assembly for displaying information to a user. The incline adjustment system includes a lever and a lift motor, the lever having a first end rotatably coupled to a frame of the deck assembly. The generator system includes a flywheel generator coupled to at least one of a forward or rear roller and configured to generate electricity as a result of the at least one of the forward or rear rollers rotating with respect to the frame, wherein the flywheel generator is configured to provide power to the electronic display device and the lift motor.

25 Claims, 24 Drawing Sheets

Related U.S. Application Data

(60) Provisional application No. 62/067,930, filed on Oct. 23, 2014.

(51) Int. Cl.

| | |
|---|---|
| ***A63B 21/00*** | (2006.01) |
| ***A63B 21/22*** | (2006.01) |
| ***A63B 22/00*** | (2006.01) |
| ***A63B 71/00*** | (2006.01) |

(52) U.S. Cl.

CPC ..... *A63B 22/0228* (2015.10); *A63B 71/0622* (2013.01); *A63B 21/225* (2013.01); *A63B 22/0023* (2013.01); *A63B 71/0686* (2013.01); *A63B 2071/0072* (2013.01); *A63B 2071/0081* (2013.01); *A63B 2071/065* (2013.01); *A63B 2220/13* (2013.01); *A63B 2230/015* (2013.01)

(56) References Cited

U.S. PATENT DOCUMENTS

| | | | | |
|---|---|---|---|---|
| 3,643,943 | A * | 2/1972 | Erwin, Jr. | A61B 5/221 482/8 |
| 3,689,066 | A | 9/1972 | Hagen | |
| 4,066,257 | A | 1/1978 | Moller | |
| 4,151,988 | A | 5/1979 | Nabinger | |
| 4,544,152 | A | 10/1985 | Taitel | |
| 4,659,074 | A | 4/1987 | Taitel et al. | |
| 4,860,763 | A | 8/1989 | Schminke | |
| 5,100,127 | A | 3/1992 | Melnick et al. | |
| 5,314,391 | A | 5/1994 | Potash et al. | |
| 5,368,532 | A | 11/1994 | Farnet | |
| 5,382,033 | A | 1/1995 | Cheu | |
| 5,385,520 | A | 1/1995 | Lepine et al. | |
| 5,429,563 | A | 7/1995 | Engel et al. | |
| 5,447,479 | A | 9/1995 | Gvoich | |
| 5,476,430 | A | 12/1995 | Lee et al. | |
| 5,626,538 | A | 5/1997 | Dalebout et al. | |
| 5,676,624 | A * | 10/1997 | Watterson | A63B 22/0012 482/54 |
| 5,871,421 | A | 2/1999 | Trulaske et al. | |
| 5,993,358 | A | 11/1999 | Gureghian et al. | |
| 6,010,432 | A | 1/2000 | Vawter | |
| 6,010,465 | A | 1/2000 | Nashner | |
| 6,013,011 | A | 1/2000 | Moore et al. | |
| 6,045,490 | A | 4/2000 | Shafer et al. | |
| 6,123,647 | A | 9/2000 | Mitchell | |
| 6,135,924 | A | 10/2000 | Gibbs et al. | |
| 6,174,267 | B1 | 1/2001 | Dalebout et al. | |
| 6,287,240 | B1 | 9/2001 | Trabbic | |
| 6,419,611 | B1 | 7/2002 | Levine et al. | |
| 6,527,678 | B1 | 3/2003 | Wang et al. | |
| 6,561,953 | B1 * | 5/2003 | Chang | A63B 22/0235 482/51 |
| 6,645,126 | B1 | 11/2003 | Martin et al. | |
| 6,719,669 | B1 | 4/2004 | Wang et al. | |
| 6,783,482 | B2 | 8/2004 | Oglesby et al. | |
| 6,878,100 | B2 | 4/2005 | Frykman et al. | |
| 6,893,382 | B1 | 5/2005 | Moon et al. | |
| 7,008,352 | B2 | 3/2006 | Grossi | |
| 7,507,187 | B2 | 3/2009 | Dyer et al. | |
| 7,547,854 | B1 | 6/2009 | Anderson | |
| 7,563,205 | B2 | 7/2009 | Ailing | |
| 7,641,597 | B2 | 1/2010 | Schmidt | |
| 7,648,441 | B2 | 1/2010 | Silk | |
| 7,811,209 | B2 | 10/2010 | Crawford et al. | |
| 7,955,225 | B1 | 6/2011 | James | |
| 8,007,408 | B1 | 8/2011 | Moran et al. | |
| 8,435,160 | B1 | 5/2013 | Clum et al. | |
| 2002/0180166 | A1 | 12/2002 | Voss | |
| 2003/0153434 | A1 | 8/2003 | Dalebout et al. | |
| 2004/0176220 | A1 | 9/2004 | Sherman | |
| 2005/0164838 | A1 | 7/2005 | Watterson et al. | |
| 2006/0019783 | A1 | 1/2006 | Hoag | |
| 2007/0117687 | A1 * | 5/2007 | Larson | A63B 22/203 482/70 |
| 2008/0004162 | A1 * | 1/2008 | Chen | A63B 22/02 482/54 |
| 2009/0124938 | A1 | 5/2009 | Brunner | |
| 2009/0181829 | A1 | 7/2009 | Wu | |
| 2010/0105527 | A1 | 4/2010 | Johnson | |
| 2010/0160115 | A1 * | 6/2010 | Morris | A63B 22/0235 482/4 |
| 2012/0010048 | A1 * | 1/2012 | Bayerlein | A63B 22/0023 482/2 |
| 2012/0021873 | A1 | 1/2012 | Brunner | |
| 2012/0178590 | A1 | 7/2012 | Lu | |
| 2012/0277065 | A1 | 11/2012 | Moon et al. | |
| 2013/0005533 | A1 | 1/2013 | Al et al. | |
| 2013/0178337 | A1 * | 7/2013 | Brammer | A63B 71/0622 482/9 |
| 2013/0184125 | A1 | 7/2013 | Maguire | |
| 2013/0225371 | A1 | 8/2013 | Harrer et al. | |
| 2014/0011642 | A1 | 1/2014 | Astilean | |
| 2014/0066263 | A1 | 3/2014 | Huang et al. | |

FOREIGN PATENT DOCUMENTS

| | | |
|---|---|---|
| CN | 202777636 U | 3/2013 |
| EP | 0956884 | 8/2004 |
| GB | 2135202 | 8/1984 |
| GB | 2410727 | 8/2005 |
| GB | 2415393 | 12/2005 |
| JP | S62-258684 | 11/1987 |
| JP | H09-122269 | 5/1997 |
| JP | H09-313638 | 12/1997 |
| JP | 2004-154511 | 6/2004 |
| JP | 2005-296649 | 10/2005 |
| JP | 2010-259520 | 11/2010 |
| KR | 1020030086404 | 11/2003 |
| WO | WO 87/05727 | 9/1987 |
| WO | WO 89/07473 | 8/1989 |
| WO | WO 2007015619 | 2/2007 |
| WO | WO 2008/099429 | 8/2008 |
| WO | WO 2008/099430 | 8/2008 |
| WO | WO 2010/039674 | 4/2010 |
| WO | WO 2011/079320 | 6/2011 |

OTHER PUBLICATIONS

International Search Report and Written Opinion for Application No. PCT/US15/56770, dated Mar. 4, 2016, in 21 pages.

International Preliminary Report on Patentability for Application No. PCT/US15/56770, dated Aug. 3, 2017, in 29 pages.

Belli et al., "A Treadmill Ergometer for Three-Dimensional Ground Reaction Forces Measurement During Walking", Journal of Biomechanics 34:105-112 (2001).

Chauhan et al., "Control of an Omnidirectional Walking Simulator", *Experimental Robotics*, Springer Tracts in Advanced Robotics 79:811-822, DOI: 10.1007/978-3-642-28572-1_56 © Springer-Verlag Berlin Heidelberg (2014).

Du et al., "Design and Research on New Type Treadmill", Advanced Materials Research, 538:2923-2926 (2012).

Hirokawa et al., "Biofeedback Gait Training System", Biom., XI-B (713):1004-1009 (1988).

Hodgkins et al., "Development of a Highly Adjustable Cushioned Treadmill", The Engineering of Sport 6:69-74 (2006).

Kram et al., "A treadmill-mounted force platform", the American Physiological Society, Journal of Applied Physiology 67(4):1692-1698 (1989).

* cited by examiner

CORDLESS TREADMILL

CROSS REFERENCE

This application is a continuation of U.S. patent application Ser. No. 15/521,270, titled CORDLESS TREADMILL, filed Apr. 21, 2017, which is the U.S. National Phase under 35 U.S.C. § 371 of International Application No. PCT/US2015/056770, titled CORDLESS TREADMILL, filed Oct. 21, 2015, which claims the priority benefit under 35 U.S.C. § 119 of U.S. Patent Application No. 62/067,930, titled CORDLESS TREADMILL, filed Oct. 23, 2014. Each of the foregoing applications is hereby incorporated by reference herein in its entirety.

BACKGROUND

Field

The present inventions relate to exercise equipment, such as treadmills.

Description of the Related Art

Conventional cordless treadmills are bulky and difficult to assemble. Additionally, it can be difficult for lightweight users to start and stop the belt of a conventional cordless treadmill.

SUMMARY

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught or suggested herein without necessarily achieving others.

Embodiments described herein include a self-propelled treadmill having smooth starting and stopping features. For example, an integrated flywheel generator and gearing system and sensors configured to detect an amount of deflection of a treadmill deck may be capable of providing a smooth starting operation of the treadmill belt, regardless of the weight of the user. In various embodiments, the treadmill may also include a variable impact absorption system that may include sensors and absorption components to measure and maintain the deflection of the treadmill deck while a user walks or runs on the treadmill.

In one embodiment, a cordless treadmill includes a frame, comprising a first side surface, a second side surface opposite the first side surface, and a bottom surface, the first side surface and the second side surface generally orthogonal to the bottom surface such that the first side surface, second surface and bottom surface define a U-shaped channel extending generally lengthwise of the treadmill, the frame further comprising a plurality of openings in the side surfaces; a belt system, comprising a forward roller configured to roll on a forward axle and a rear roller configured to roll on a rear axle, the forward and rear axles extending laterally from the forward and rear rollers, respectively, such that the forward and rear axles support and allow rotation of the forward and rear rollers in the frame, and a belt placed around the forward and rear rollers; and a cartridge, comprising a first roller having a longitudinal axis that extends along a width of the frame and a second roller adjacent to and laterally spaced apart from the first roller, wherein a longitudinal axis of the second roller extends along the width of the frame, and wherein the longitudinal axis of the first roller and the longitudinal axis of the second roller are offset from each other by a predetermined distance, the cartridge further comprising a first collinear roller and a second collinear roller, wherein the first and second collinear rollers extend along a width of the frame and each of the first and second collinear rollers are adjacent to the first and second rollers such that the first collinear roller is on an opposite side of the first and second rollers than the second collinear roller, the cartridge further comprising at least one connecting member mounted to each of the first and second rollers and the first and second collinear rollers such that a first tab and a second tab extend laterally from each side of the mounted rollers, the cartridge configured such that the endless belt of the belt system rotates over and is supported by the cartridge; wherein the frame is adapted to receive the belt system and the cartridge as they are lowered into the frame, and wherein the frame is adapted to place the belt of the belt system into tension as the belt system is lowered into the frame. In some embodiments, at least one of the openings in the side surfaces of the frame has an arcuate shape that extends in an arcuate path through the side surface of the frame such that the belt of the belt system is placed into tension as the belt system is lowered into the at opening in the side surface of the frame system.

In another embodiment, a cordless treadmill includes a frame, comprising a first side surface, a second side surface opposite the first side surface, and a bottom surface, the first side surface and the second side surface generally orthogonal to the bottom surface such that the first side surface, second surface and bottom surface define a U-shaped channel extending generally lengthwise of the treadmill, the frame further comprising a plurality of openings in the side surfaces; a belt system, comprising a forward roller configured to roll on a forward axle and a rear roller configured to roll on a rear axle, the forward and rear axles extending laterally from the forward and rear rollers, respectively, such that the forward and rear axles support and allow rotation of the forward and rear rollers in the frame, and a belt placed around the forward and rear rollers; a cartridge, comprising a first roller having a longitudinal axis that extends along a width of the frame and a second roller adjacent to and laterally spaced apart from the first roller, wherein a longitudinal axis of the second roller extends along the width of the frame, and wherein the longitudinal axis of the first roller and the longitudinal axis of the second roller are offset from each other by a predetermined distance, the cartridge further comprising a first collinear roller and a second collinear roller, wherein the first and second collinear rollers extend along a width of the frame and each of the first and second collinear rollers are adjacent to the first and second rollers such that the first collinear roller is on an opposite side of the first and second rollers than the second collinear roller, the cartridge further comprising at least one connecting member mounted to each of the first and second rollers and the first and second collinear rollers such that a first tab and a second tab extend laterally from each side of the mounted rollers, the cartridge configured such that the endless belt of the belt system rotates over and is supported by the cartridge; and a flywheel generator system rotatably connected to the forward roller such that rotation of the forward roller rotates a gearing assembly of the flywheel generator system to generate electricity and control an initial rotational resistance of the front roller; wherein the frame is adapted to receive the belt system and the cartridge as they are lowered into the frame, and wherein the frame is adapted to place the belt of the belt system into tension as the belt system is lowered into the frame.

In yet another embodiment, a cordless treadmill includes a frame, comprising a first side surface, a second side surface opposite the first side surface, and a bottom surface, the first side surface and the second side surface generally orthogonal to the bottom surface such that the first side surface, second surface and bottom surface define a U-shaped channel extending generally lengthwise of the treadmill, the frame further comprising a plurality of openings in the side surfaces; a belt system, comprising a forward roller configured to roll on a forward axle and a rear roller configured to roll on a rear axle, the forward and rear axles extending laterally from the forward and rear rollers, respectively, such that the forward and rear axles support and allow rotation of the forward and rear rollers in the frame, and a belt placed around the forward and rear rollers; a cartridge, comprising a first roller having a longitudinal axis that extends along a width of the frame and a second roller adjacent to and laterally spaced apart from the first roller, wherein a longitudinal axis of the second roller extends along the width of the frame, and wherein the longitudinal axis of the first roller and the longitudinal axis of the second roller are offset from each other by a predetermined distance, the cartridge further comprising a first collinear roller and a second collinear roller, wherein the first and second collinear rollers extend along a width of the frame and each of the first and second collinear rollers are adjacent to the first and second rollers such that the first collinear roller is on an opposite side of the first and second rollers than the second collinear roller, the cartridge further comprising at least one connecting member mounted to each of the first and second rollers and the first and second collinear rollers such that a first tab and a second tab extend laterally from each side of the mounted rollers, the cartridge configured such that the endless belt of the belt system rotates over and is supported by the cartridge; and a flywheel generator system rotatably connected to the forward roller such that rotation of the forward roller rotates a generator configured with the forward roller to generate electricity and control an initial rotational resistance of the front roller; wherein the frame is adapted to receive the belt system and the cartridge as they are lowered into the frame, and wherein the frame is adapted to place the belt of the belt system into tension as the belt system is lowered into the frame.

In some embodiments, the treadmill further includes a variable impact absorption system for a treadmill, the variable impact system including at least one shock absorbing members mounted to a walking surface of the treadmill; at least one sensor mounted to the walking surface of the treadmill, the at least one sensor configured to measure an amount of deflection of the walking surface of the treadmill; and a control system connected to the at least one shock absorbing member and the at least one sensor such that an amount of shock absorption may be adjusted due to the amount of deflection of the walking surface of the treadmill.

In some embodiments, the treadmill further includes an automatic stopping system, the automatic stopping system comprising at least one sensor and a control system, wherein the control system is configured to slow or stop the treadmill belt when a predetermined percentage of the body weight of a user has shifted a predetermined distance from an expected use position.

In some embodiments, the treadmill further includes a visual feedback system, the visual feedback system comprising a plurality of lights for displaying visual feedback to a user, at least one sensor, and a control system, wherein the control system is configured to receive at least one signal from the at least one sensor indicating a duration or amount of pressure on the treadmill belt, determining whether the duration or amount of pressure falls within a predetermined desired or undesired range, and trigger at least one of the plurality of lights to illuminate and indicate whether the detected duration or pressure is within a desired or undesired range.

In some embodiments, the frame has a wedge-shape such that a front portion is at a higher elevation than a rear portion. In some embodiments, the treadmill further includes a lift actuator and a plurality of springs, wherein the springs and the lift actuator are configured to provide a lift force to raise the treadmill to a desired incline. In some embodiments, the springs are gas springs.

In some embodiments, the treadmill further includes a plurality of step detection sensors connected to the frame to measure the position of a user's steps on the belt system of the treadmill, wherein the weight of a user transitions from a forward portion of the belt to a rear portion of the belt as the treadmill belt rotates and wherein, if one or more of the plurality of step detection sensors detects a step that does not originate in the front portion of the belt, a control system slows and stops the treadmill belt to prevent user injury.

In another embodiment, a variable impact absorption system for a treadmill, includes at least one shock absorbing members mounted to a walking surface of the treadmill; at least one sensor mounted to the walking surface of the treadmill, the at least one sensor configured to measure an amount of deflection of the walking surface of the treadmill; and a control system connected to the at least one shock absorbing member and the at least one sensor such that an amount of shock absorption may be adjusted due to the amount of deflection of the walking surface of the treadmill.

In yet another embodiment, a treadmill includes a frame, the frame comprising a first side surface, a second side surface, and a bottom surface extending at least partially between the first and second side surfaces, wherein the first and second side surfaces and bottom surface define a U-shaped channel, wherein the first side surface comprises a first opening extending from an upper edge of the first side surface towards the bottom surface and wherein the second side surface comprises a second opening extending from an upper edge of the second surface towards the bottom surface; and an axle, the axle extending at least from the first opening to the second opening, wherein the first and side surfaces are adapted to receive and secure the axle as it is lowered into the first and second openings.

In another embodiment, a treadmill includes a frame; a cartridge coupled to the frame, the cartridge including a first roller, wherein a longitudinal axis of the first roller extends along a width of the frame; a second roller adjacent to and laterally spaced apart from the first roller, wherein a longitudinal axis of the second roller extends along the width of the frame, wherein the longitudinal axis of the first roller and the longitudinal axis of the second roller are offset from each other by a predetermined distance. In some embodiments, the predetermined distance is half of a diameter of the first roller. In some embodiments, the predetermined distance is one quarter of a diameter of the first roller.

In yet another embodiment, a method of controlling treadmill belt rotation, includes determining a weight of a treadmill user; determining an available torque based upon the weight of the treadmill user and one or more treadmill settings; determining a required torque based upon the weight of the treadmill user, wherein the required torque corresponds to an amount of torque used to initiate movement of a treadmill belt in response to movement of the user; and setting a gear ratio of a flywheel generator based upon the available torque and the required torque. In some embodiments, determining the weight of the treadmill user includes determining a deflection of a treadmill deck after the user steps onto the treadmill deck. In some embodiments, the one or more treadmill settings includes an incline of a treadmill deck. In some embodiments, determining the available torque is further based upon friction associated with one or more treadmill components.

BRIEF DESCRIPTION OF THE DRAWINGS

Throughout the drawings, references numbers can be re-used to indicate correspondence between reference elements. The drawings are provided to illustrate embodiments of the inventions described herein and not to limit the scope thereof.

DETAILED DESCRIPTION

Figure 1A:
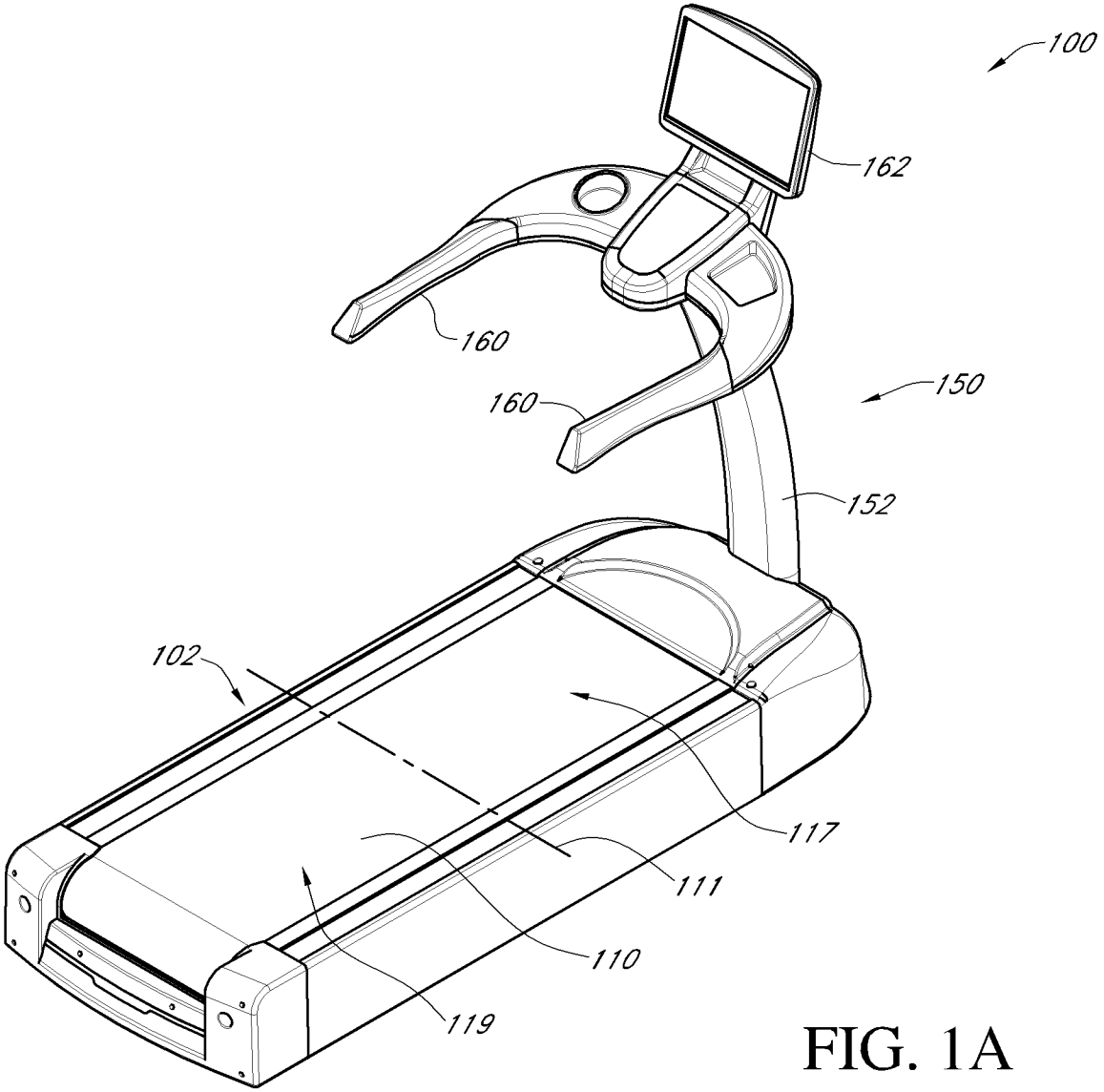
FIGS. 1A and 1B illustrate a cordless treadmill having at least some of the features discussed below, according to one embodiment.

Various embodiments will be described hereinafter with reference to the accompanying drawings. These embodiments are illustrated and described by example only, and are not intended to be limiting.

It is noted that the examples may be described as a process, which is depicted as a flowchart, a flow diagram, a finite state diagram, a structure diagram, or a block diagram. Although a flowchart may describe the operations as a sequential process, many of the operations can be performed in parallel, or concurrently, and the process can be repeated. In addition, the order of the operations may be re-arranged. A process is terminated when its operations are completed. A process may correspond to a method, a function, a procedure, a subroutine, a subprogram, etc. When a process corresponds to a software function, its termination corresponds to a return of the function to the calling function or the main function.

Embodiments may be implemented in hardware, software, firmware, or any combination thereof. Those of skill in the art will understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

In the following description, specific details are given to provide a thorough understanding of the examples. However, it will be understood by one of ordinary skill in the art that the examples may be practiced without these specific details. For example, electrical components/devices may be shown in block diagrams in order not to obscure the examples in unnecessary detail. In other instances, such components, other structures and techniques may be shown in detail to further explain the examples.

Overview

A cordless treadmill according to some embodiments discussed below includes a geared flywheel and generator system to improve the starting and stopping action of the treadmill belt. The treadmill includes a belt that passes over a front roller connected to the flywheel and generator system and a rear roller, and the speed and movement of the belt changes in response to the user increasing or decreasing the speed of his or her stride on the belt. The treadmill is further adapted to generate electrical energy in response to the rotation of the treadmill belt (and thus rotation of the flywheel and generator system) that occurs due to the user's steps. A treadmill according to some embodiments includes a "drop-in" frame design in which the various components of the treadmill may be adapted to couple to the frame via slotted openings. The frame may be constructed as a single metal or composite member. The drop-in frame design improves the ease of assembly, maintenance and serviceability of the treadmill. In some embodiments, a treadmill includes a cartridge adapted to support the treadmill belt. The cartridge includes roller channels extending the length of the treadmill. The roller channels are staggered such that the center of each roller is not aligned with center of adjacent rollers, producing a staggered roller section of the cartridge. For example, the longitudinal axes of adjacent sets of rollers may be offset a predetermined distance. In some embodiments, a section of staggered rollers is flanked by a channel of collinear rollers such that one channel of collinear rollers is on one side of the section of staggered rollers and a second channel of collinear rollers is on the opposite side of the section of staggered rollers. The collinear rollers are not aligned with the centers of the plurality of staggered rollers such that when a user steps on the collinear rollers, the user will experience a "bumpy" feel. Stepping on the collinear rollers provides instant feedback to the user that his feet have drifted from a target area of the belt, and help guide the user's steps back to the staggered roller section of the cartridge.

In some embodiments, the treadmill includes a variable impact absorption system (VIAS) adapted to measure deflection of the treadmill deck or cartridge during use. The variable impact absorption system is adapted to interface and communicate with the flywheel generator system to minimize deck deflection and maximize energy transfer to the generator system.

In some embodiments, the treadmill incorporates an automatic stop feature to slow or stop the rotation of the treadmill belt when the user has stepped off the treadmill. In some embodiments, the automatic stop feature may slow or stop the treadmill belt if the user is too close to the front or rear of the treadmill, as detected by sensors incorporated into the VIAS system. In some embodiments, additional sensors and/or the sensor used by the VIAS system may detect whether a user steps on a front portion or a rear portion of the treadmill deck. If the user's step is detected in an undesirable, unexpected, or unsafe position, the treadmill can be slowed or stopped to prevent injury to the user.

Some embodiments of the treadmill incorporate a visual feedback system. The visual feedback system desirably indicates to the user whether the impact (e.g., force, pressure, shock, etc.) of each foot is more or less than a desired amount. Additionally, in some embodiments, the visual feedback system may also indicate to the user whether the left and right strides are in line or out of line, allowing the user to learn to take more efficient or properly placed strides which may be helpful during physical therapy and/or patient rehabilitation.

Some embodiments of the treadmill incorporate a multi-faceted method of speed control using one or more of eddy current braking, resistive braking, and frictional braking to control the speed of the treadmill belt within a user-defined desired speed. Each of the methods of speed control may be used individually or in combination to obtain the desired treadmill belt speed. Factors such as the user's weight, desired speed, treadmill incline position, and/or speed of rotation of the flywheel, as determined by various sensors located in the treadmill, as described below, may be used to determine which speed control method or methods to use to obtain the desired speed setting and improve safe performance of the treadmill.

Other embodiments of the treadmill may include a wedge-shaped frame design. A wedge-shaped frame allows the rear section to be at a lower elevation than the front section without compromising performance of the treadmill, as discussed in greater detail below.

Additional embodiments of the treadmill incorporate a supplemental lift assist system to assist the lift motor in achieving a treadmill incline position.

A treadmill having some or all of the embodiments discussed above, including a "drop-in" and "snap-in" frame design in which gravity is the primary force used to retain the components, is shown in FIGS. 1A and B. The frame is a single piece of metal or composite having multiple slots and openings that align with corresponding laterally extending pieces of a cartridge that. The cartridge, along with the treadmill belt, provides a semi-flexible surface upon which the user can walk or run. Similarly, the treadmill's front and rear rollers also slide into slots positioned at the front and back portions of the frame. Gravity and the weight of the user secure the cartridge in the frame.

Figure 1B:
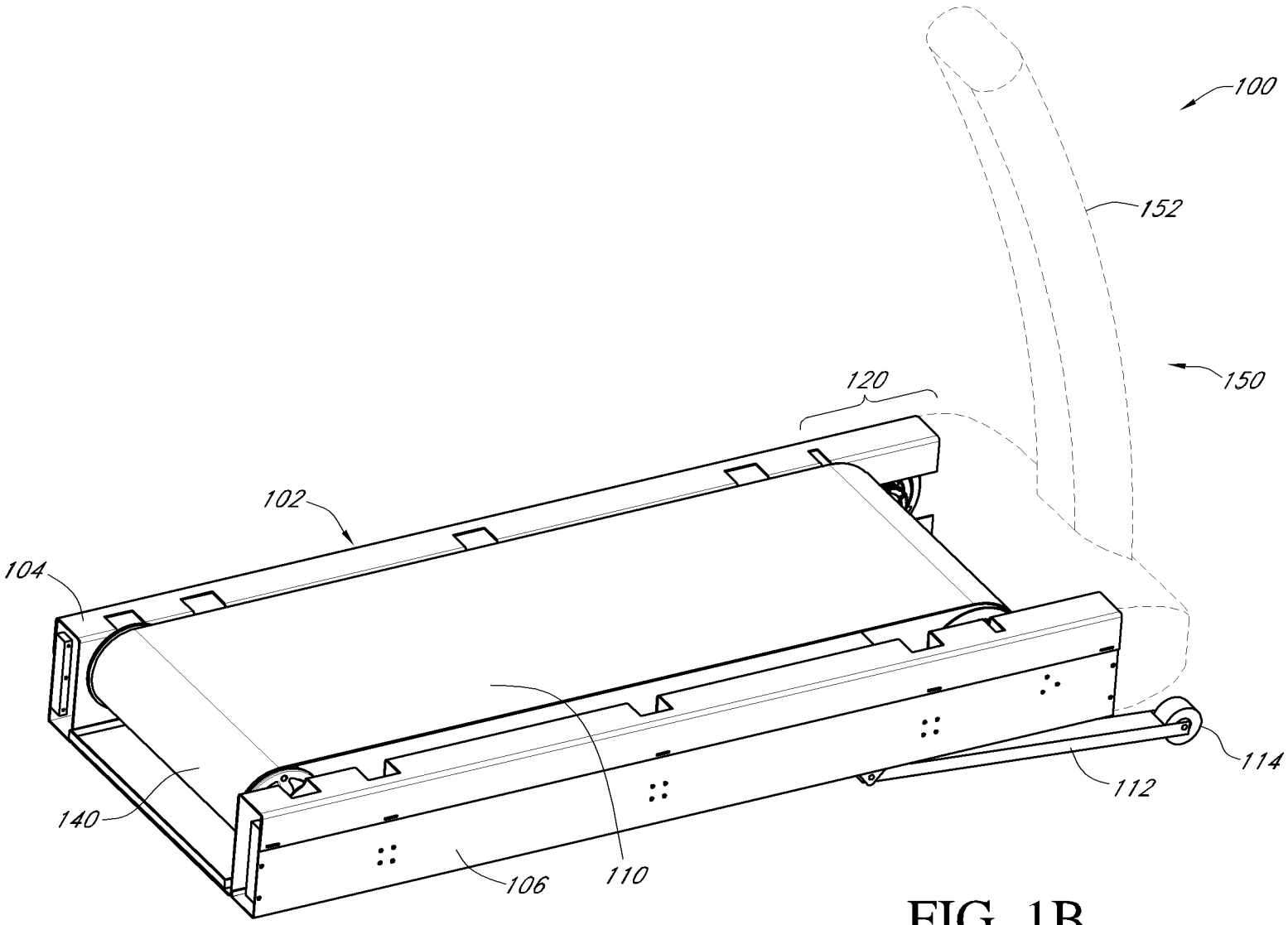

The self-powered treadmill 100 according to the embodiment shown in FIG. 1A and the partial exploded view of FIG. 1B includes a deck assembly 102 and a display assembly 150. The deck assembly 102 includes a belt 110 that rotates around two rollers, a front roller assembly 120 and a rear roller assembly 140. The front roller assembly 120 and rear roller assembly 140 are supported by a frame 104 that is designed such that the roller assemblies may be dropped or slotted into the frame 104 for easy assembly. The belt 110 is supported by a cartridge that is supported by the frame 104. The cartridge supports the weight of the user, as discussed in greater detail below. The deck assembly 102 provides a stable surface for running or walking. Side rails, such as side rail 106, may be attached to either side of the frame 104 to provide additional support for the frame 104 and to conceal and protect other treadmill components, such as a cushioning system described in further detail below. In some embodiments, the treadmill 100 may also include an incline adjustment assembly that may include a lever 112 that is rotatably connected at one end to the frame 104. The opposite end of the lever 112 may include a wheel 114 such that the wheeled end of lever 112 can easily roll towards the frame 104 of the treadmill 100 to incline the front end of the treadmill 100 such that the front end of the treadmill 100 is at a higher elevation than the rear end of the treadmill 100. Additional supports may be included to provide additional support for the treadmill 100 and to level the treadmill 100 on a surface.

As illustrated, the treadmill 100 does not include railings or arm supports. However, in other embodiments, railings and/or arm supports may be provided, e.g., for users with balance issues.

As shown in FIGS. 1A and B, the treadmill 100 also includes a display assembly 150. The display assembly 150 may include a pedestal 152 that extends upward from the front end of the treadmill 100. The pedestal 152 may be used to support user controls for the treadmill and/or a display console including a video screen, LED light display, or other display device to display information to the user. Such information may include belt speed, treadmill incline, the user's lateral position on the belt, the impact force of a user's feet on the treadmill, etc. Additionally, in some embodiments, the display means may be powered by electrical energy created by the rotational movement of the treadmill belt 110 or by a battery. The energy capture and generation may be accomplished with an integrated flywheel and generator system connected to rotation of the front or rear roller, as described in further detail below.

In one embodiment, the front roller assembly 120 and the rear roller assembly 140 are configured such that operation of the belt 110 is smooth and controlled for all users. For example, to start operation of the treadmill 100, the user begins walking on the belt 110. A conventional cordless treadmill will require a large amount of force to overcome the resistance and friction of the roller assemblies, etc. to initiate operation of the belt 110. Such conventional cordless treadmills are therefore uncomfortable and difficult to use. In the illustrated embodiment, the treadmill 100 is configured such that the front roller assembly 120 and/or the rear roller assembly 140 allow the user to initiate operation of the belt 110 using reduced force. Preferably, a user weighing, for example, 100 lbs., can initiate movement of the belt 110 as easily as a user weighing, for example, 250 lbs. Therefore, in a preferred embodiment, a gearing or transmission system as described below may be configured to determine a user's weight and adjust an initial gear position within the transmission to allow a smooth initial operation of the treadmill for both a lighter weight user and a heavier user. Additionally, a multifaceted speed control system may be used to control the speed of the treadmill to improve safe operation, as described in greater detail below.

In some embodiments, including the illustrated embodiments, the treadmill 100 includes an impact absorption system, as described in further detail below. The impact absorption system provides shock absorption as the user walks or runs on the treadmill 100. In some embodiments, the impact absorption system includes a plurality of sensors connected to a control system to measure deflection of the treadmill deck due to the user's weight or impact on the belt during walking or running. In some embodiments, the gearing and transmission system may be adjusted based on the amount of deck deflection measured by the impact absorption system.

As mentioned above and discussed in greater detail below, the treadmill 100 may also include an energy capture mechanism that can capture the rotational energy of the treadmill belt 110 and convert the rotational energy to electrical energy using, for example, an electrical generator. In some embodiments, the impact absorption system may work with the energy capture mechanism to maintain a constant amount of deck deflection during use to increase the efficient of the energy capture and conversion to electrical energy by reducing the amount of energy loss due to deck flexion.

Figure 14:
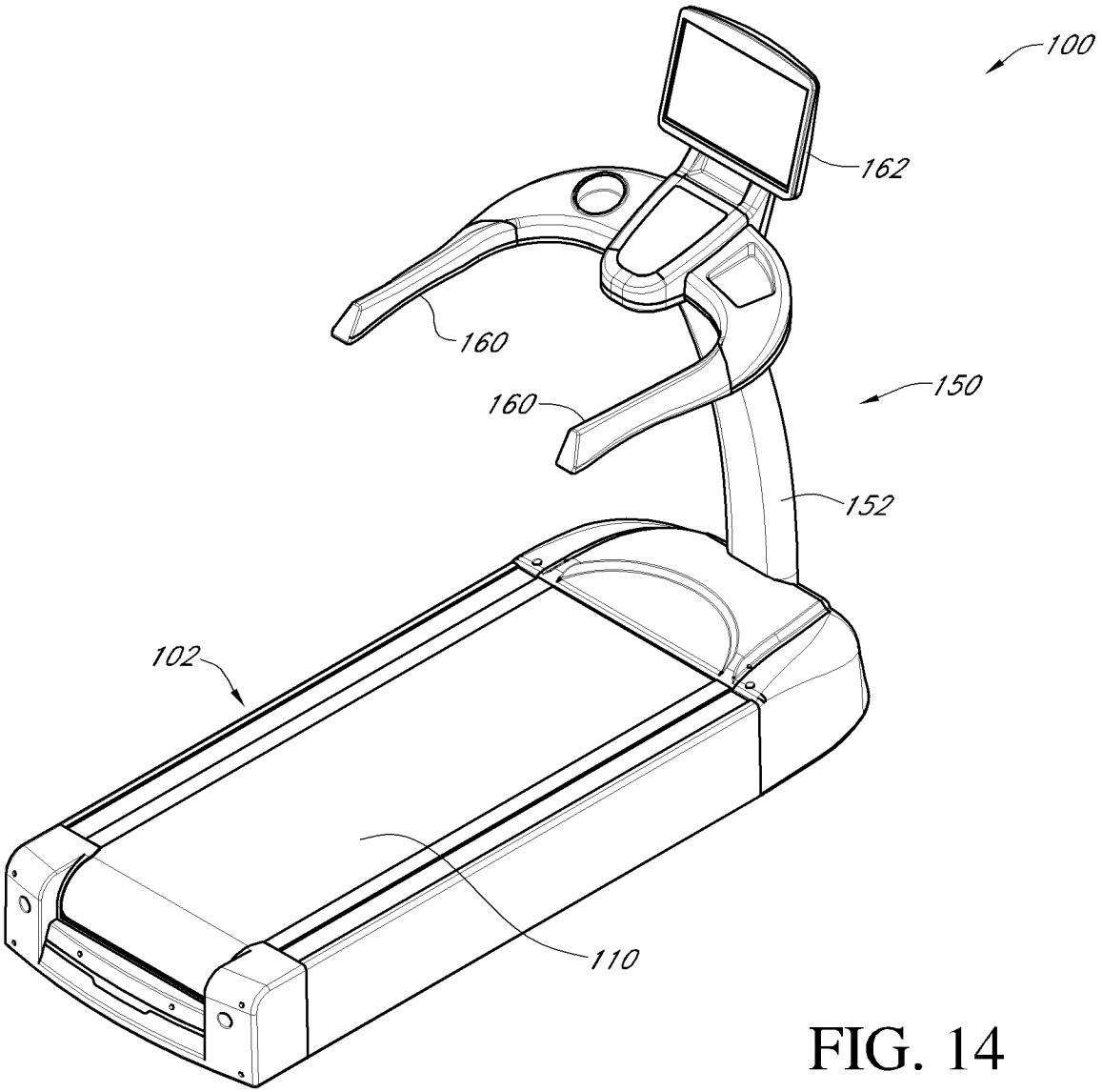
FIG. 14 illustrates a cordless treadmill having at least some of the features discussed below, according to another embodiment.

Another embodiment of a treadmill 100 is illustrated in FIG. 14. Similar to the treadmill 100 described above with respect to FIG. 1, the treadmill 100 illustrated in FIG. 14 includes a deck assembly 102 and a display assembly 150. The deck assembly 102 includes a movable treadmill belt 110 that can rotate around a front and rear roller in response to the force of a user's steps on the belt 110. The display assembly 150 may, in some embodiments, include a pair of arm members 160 that extend to either side of the belt 110 to provide a stable surface for the user's hands during treadmill use.

As in the embodiment discussed above with respect to FIGS. 1A and 1B, the treadmill illustrated in FIG. 14 may, in some embodiments, also include an impact absorption system, as described in further detail below. Additionally, in some embodiments, the treadmill 100 illustrated in FIG. 14 may include an energy capture mechanism that can capture the rotational energy of the treadmill belt 110 and convert the rotational energy to electrical energy using, for example, an electrical generator.

Figure 19:
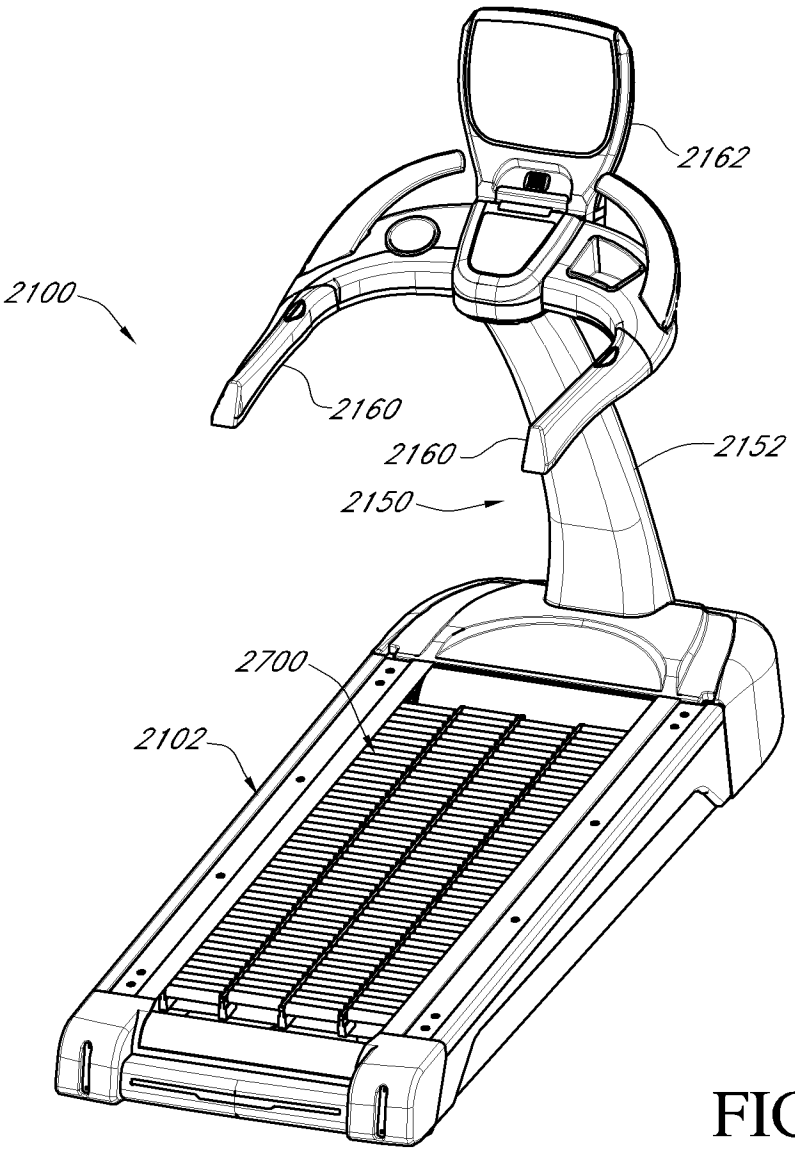
FIG. 19 illustrates another embodiment of a treadmill incorporating features disclosed herein.

Yet another embodiment of a treadmill 2100 is illustrated in FIG. 19. Similar to the treadmill 100 described above with respect to FIGS. 1A and B and FIG. 14, the treadmill 2100 includes a deck assembly 2102 and a display assembly 2150. The deck assembly 2102 includes a movable treadmill belt (not shown) that can rotate around a front and rear roller in response to the force of a user's steps on the belt. The display assembly 2150 may, in some embodiments, include a pair of arm members 2160 that extend to either side of the belt to provide a stable surface for the user's hands during treadmill use.

The treadmill 2150 may, in some embodiments, include a wedge-frame design, as described in further detail below, to reduce the step up height such that the rear portion of the treadmill is at a lower elevation than the forward portion of the treadmill. Additionally, the treadmill 2100 may include an energy capture mechanism to convert the rotation energy produced by a user walking or running on the treadmill to electrical energy. In some embodiments, the treadmill 2100 may include one or more of an impact absorption system, an automatic stop feature, a drop-in assembly, or any combination of other features discussed below with reference to the treadmills shown in FIGS. 1A and 1B and FIG. 14.

Frame

Figure 2:
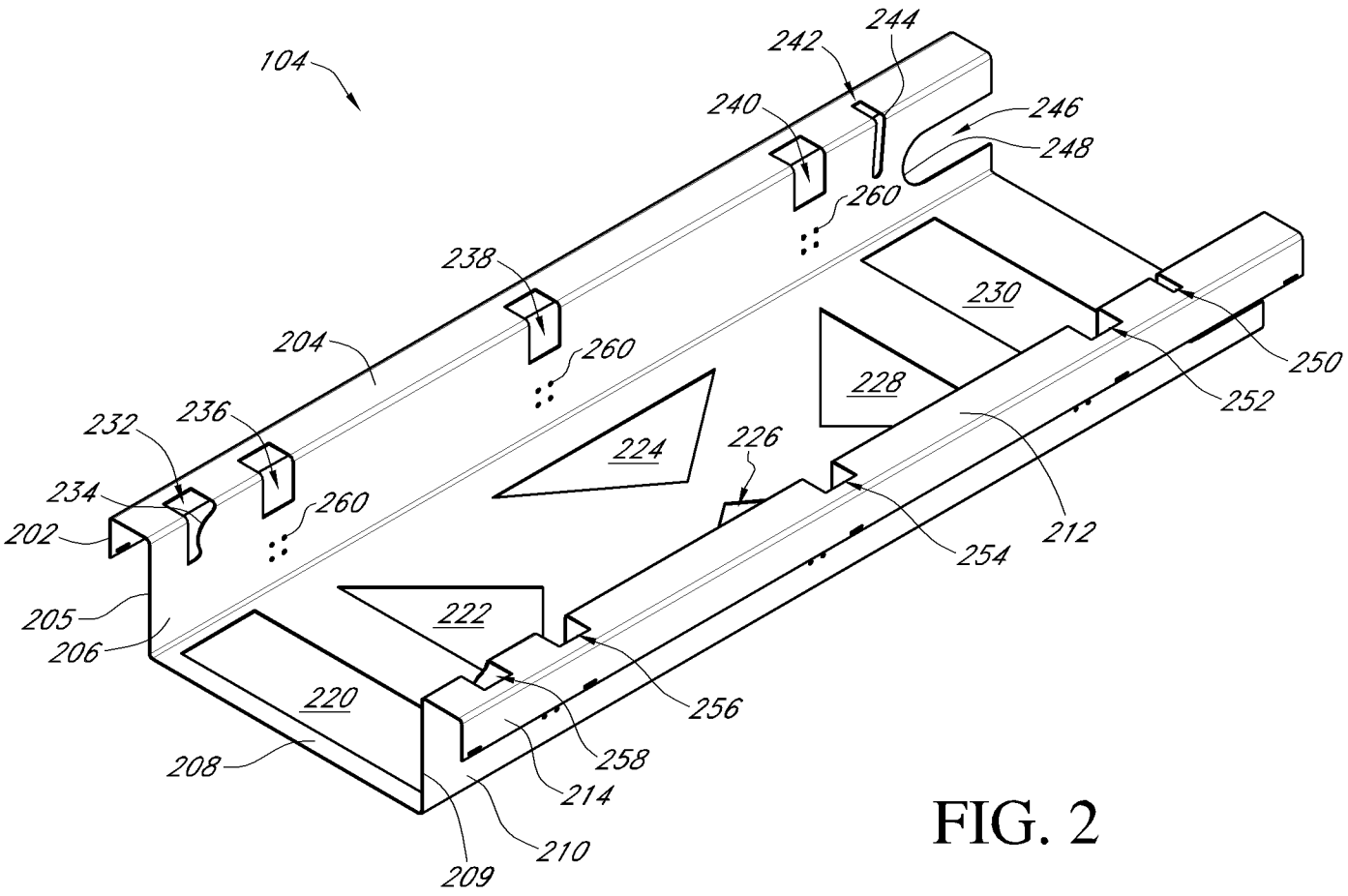
FIG. 2 illustrates one embodiment of a frame component of the treadmill illustrated in FIG. 1.

In some embodiments, as illustrated in FIG. 2, the treadmill 100 may be constructed on an easy to assemble frame, such as frame 104. In one embodiment, the frame 104 is U-shaped with the side surfaces running the length of the treadmill. The side surfaces form a channel into which various components of the treadmill 100, such as the front roller assembly 120 and the rear roller assembly 140, may be inserted. Additionally, the frame 104 includes a plurality of cutouts or openings that are configured to receive a cartridge assembly such as that discussed below. Due to gravity, minimal securing means such as mechanical fasteners, etc. are used to secure the components of the treadmill 100 to the frame 104.

The bottom of the channel is formed from bottom surface 208. A plurality of openings 220, 222, 224, 226, 228, 228, and 230 may be formed in the bottom surface 208 to reduce the weight of the frame 104. The sides of the U-shaped channel are formed from the left frame side 205 and the right frame side 209. The left frame side 205 and the right frame side 209 each form an inverted channel to provide additional rigidity to the frame 104. A left horizontal flange 204 and a left vertical flange 202 form an inverted U-shaped channel with the left frame side 205. Similarly, a right horizontal flange 212 and a right vertical flange 214 form an inverted U-shaped channel with the right frame side 209. A plurality of openings may be formed in the horizontal flanges and the frame sides such that the openings allow treadmill components, such as the treadmill motion assembly components 300, shown in FIG. 3, to be dropped from a vertical position above the frame 104 through the horizontal flanges 204, 212 and supported by the frame sides 205, 209. In some embodiments, openings on the left side 205 and through the left horizontal flange 204 are paired with symmetrical openings in the right side 209 and through the right horizontal flange 212.

Figure 4:
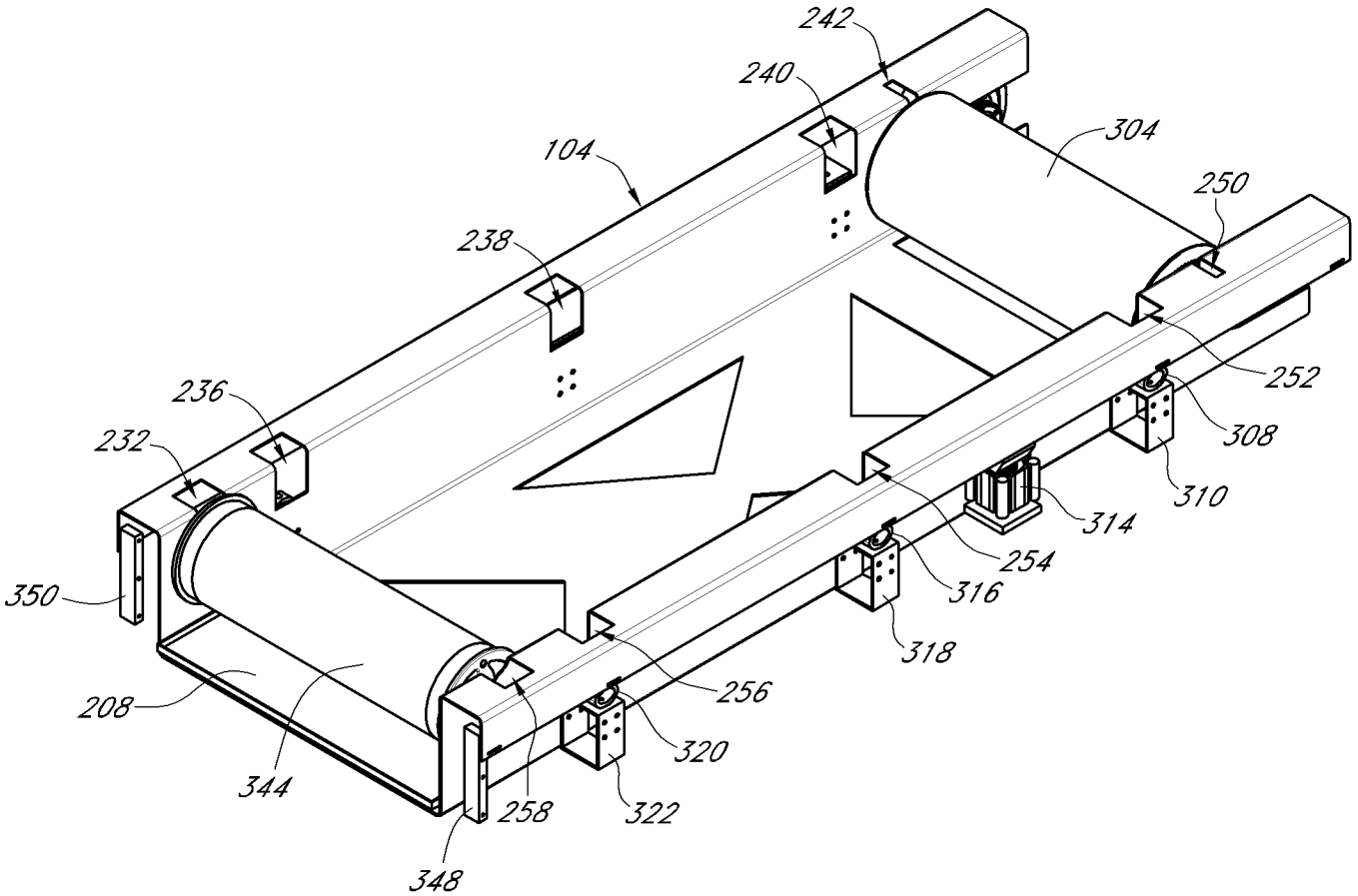
FIG. 4 illustrates the treadmill components illustrated in FIG. 3 installed in the frame component illustrated in FIG. 2, according to one embodiment.

At the front of the frame 104, a U-shaped opening 246 is illustrated in the left frame side 205. While only partially shown in FIG. 2, a symmetric U-shaped opening is also formed in the right frame side 209. The U-shaped opening 246 is formed by a curved surface 248 in the left frame side 205. The opening 246 is configured to allow a connection between the integrated flywheel generator assembly discussed in further detail below and the front roller assembly 120 shown in FIG. 1. A slotted opening 242 is formed in the left horizontal flange 204 and the left side 205. The slotted opening 242 is preferably wide enough to allow a front roller axis to fit within the slotted opening 242. Preferably, the slotted opening 242 is angled such that the end of the slotted opening 242 closest to the bottom surface 208 of the frame 104 is closer to the rear of the frame 204 than the end of the slotted opening 242 formed in the left horizontal flange 204. In some embodiments, the slotted opening 242 is angled back towards the rear of the frame 204 at an angle of approximately 30 degrees with the axis defined by the left side 205. In other embodiments, the slotted opening 242 may be angled either forward or backward at an angle between 15 degrees and 60 degrees. A symmetric slotted opening 250 is formed in the right horizontal flange 212 and the right side 209. The slotted opening 250 has a similar width and orientation as the slotted opening 242 to allow the front roller axle to pass through the opening 250. Desirably, the front roller axis is supported by the ends of the slotted openings 242, 150 such that the front roller can rotate freely within the frame 104 without contacting either of the frame sides 205, 209 or the bottom surface 208, as illustrated in FIG. 4.

With continued reference to FIG. 2, curved openings 232 and 258 are formed in the left frame side 205 and the right frame side 209, respectively. The curved opening 232 may be formed with a rectangular opening in the left horizontal flange 204 that opens into a narrow curved opening in the left side 205 formed by the curve 234. The curve 234 narrows the curved opening 232 into an opening wide enough to securely fit the rear roller axis. The curved opening 232 allows the rear roller to be dropped from a vertical position above the frame 104 into a tensioned position in the frame 104. As the rear roller axis is dropped into the curved openings 232, 258, the rear roller axis is forced into the rearward position of the opening 232, 258 by the curve 234. The dimensions and placement of the openings 232, 248, along with the corresponding slotted openings 242, 250 at the front end of the frame 104, allow the treadmill belt to be tensioned by exact placement of the front and rear rollers, around which the treadmill belt rotates. Desirably, no external tensioning of the treadmill belt is required once the front and rear roller assemblies and the treadmill belt have been dropped into place within the openings 232, 258, 242, and 250, as illustrated in FIG. 4.

FIG. 2 also illustrates that a number of rectangular openings 236, 238, 240 may be formed in the left horizontal flange 204 and the left side 205. Similar symmetric openings 252, 254, 256 may be formed in the right horizontal flange 212 and the right side 209. In some embodiments, the openings 236, 238, 240, 252, 254, 256 are configured to accept support slats that support and configure the cartridge deck of the treadmill 100, as discussed in greater detail below.

The frame 104 may also include a plurality of openings 260 formed in the left and right sides 205, 209 to secure other treadmill components, such as the VIAS system shock absorbing components, to the frame 104.

Figure 3:
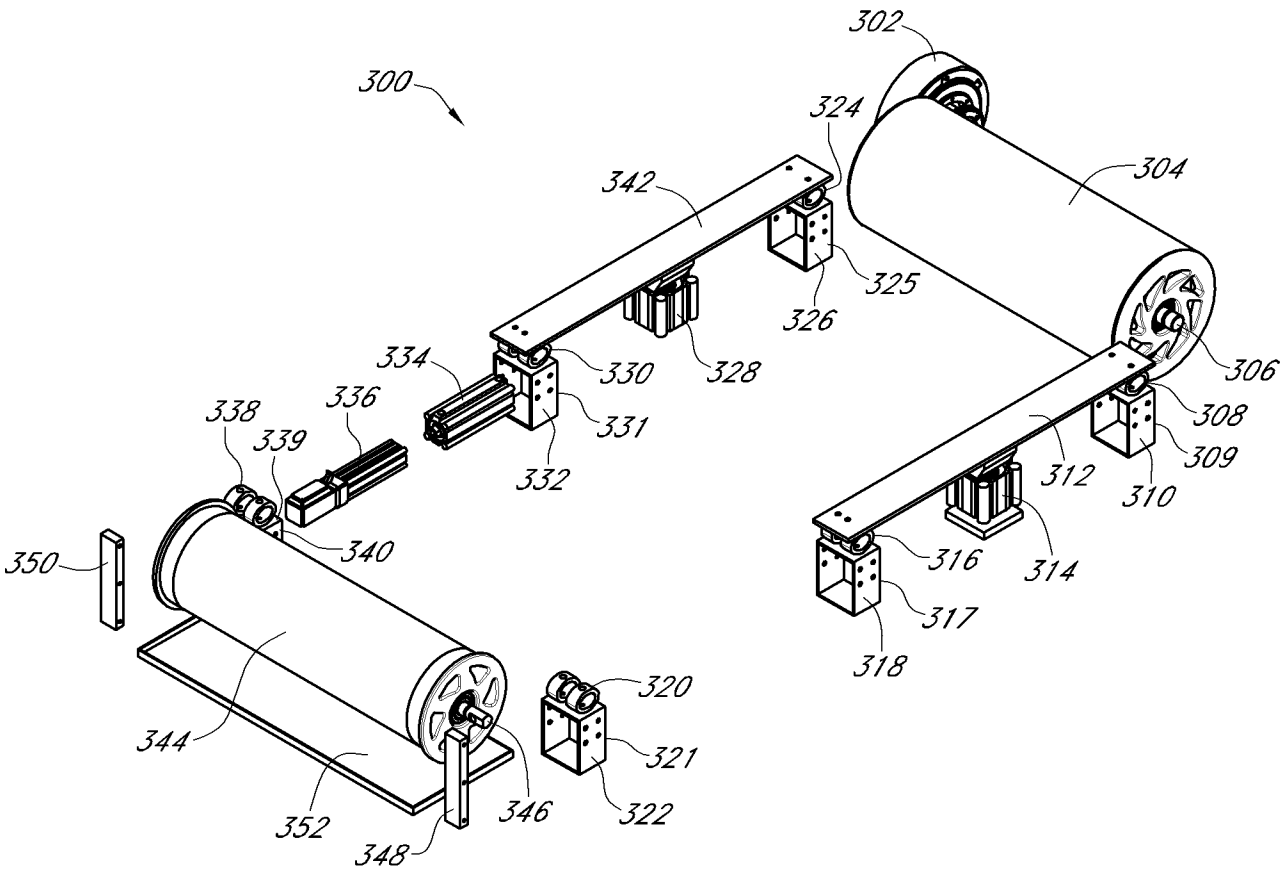
FIG. 3 illustrates belt tensioning rollers, impact absorption components, and a flywheel generator assembly for a cordless treadmill, according to one embodiment.

Some of the treadmill motion assembly and variable impact absorption system components are illustrated in FIG. 3 with the frame 104 removed to more clearly illustrate the components. The components are shown installed in the frame 104 in FIG. 4.

Figure 6:
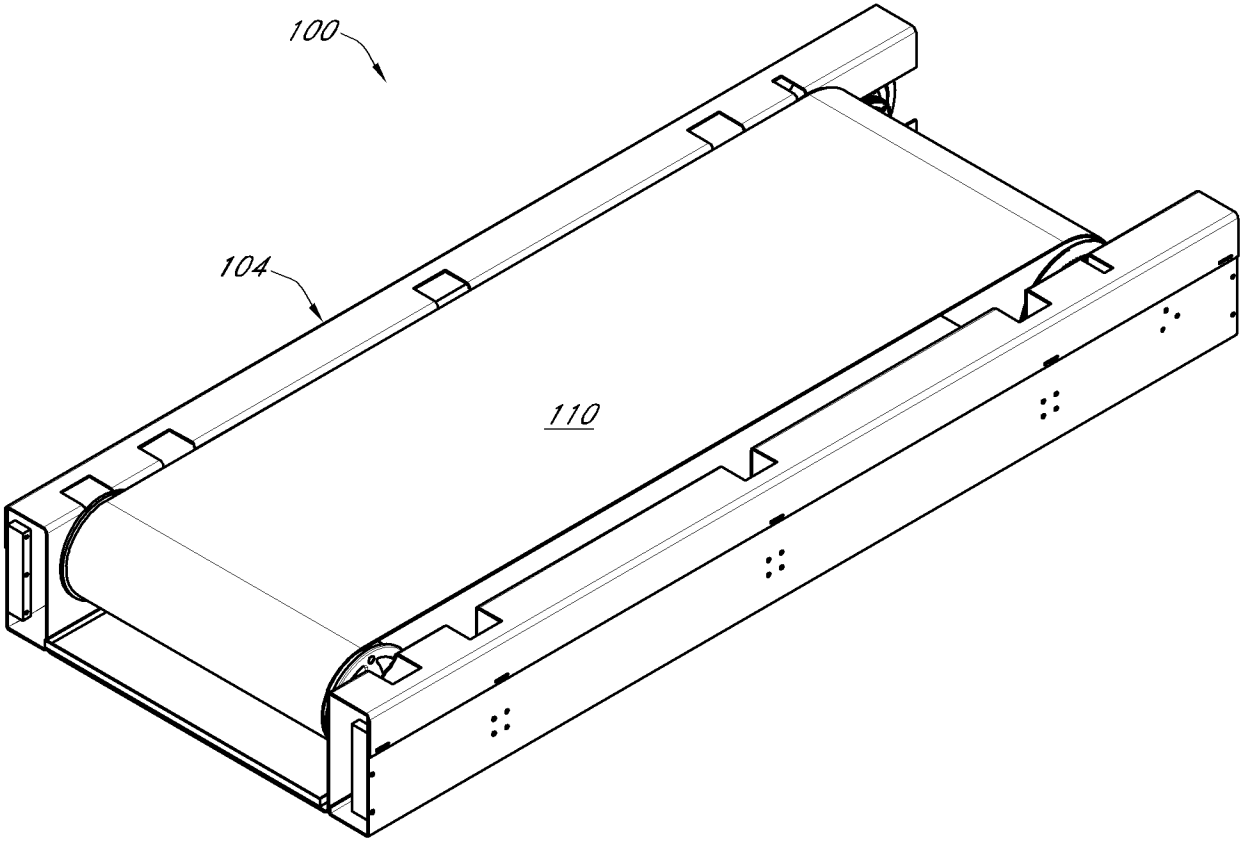
FIG. 6 illustrates the treadmill of FIG. 5 including a belt, according to one embodiment.

A front roller 304 has a front roller axis 306 passing therethrough. Similarly, a rear roller 344 has a rear roller axis 346 passing therethrough. As discussed above, the front roller axis 306 preferably extends outwards from each end of the front roller 304 such that the front roller axis 306 can fit within the slotted openings 242 and 250 in the frame 104 (FIG. 4). Similarly, the rear roller axis 346 preferably extends outwards from each end of the rear roller 344 such that the rear roller axis 346 can fit within the curved openings 232, 258 in the frame 104 (FIG. 4). The front roller 304 and the rear roller 344 are preferably configured such that a treadmill belt can fit around both the front roller 304 and the rear roller 344. Desirably, when the treadmill belt is fitted around both the front roller 304 and the rear roller 344, and the rollers and belt are dropped into the frame 104, as shown in FIG. 6, the treadmill belt is properly tensioned without the need for additional tensioning of the treadmill belt.

With continued reference to FIG. 3, additional treadmill components used for impact absorption, deck deflection, and treadmill motion control are illustrated. The integrated flywheel generator 302 includes a gearing system that compensates for the measured weight of the user to set an initial gearing of the front roller assembly 120 such that the treadmill belt has an initial resistance that allows the belt to rotate smoothly and easily for users of different weights. Additional details of the flywheel generator are discussed below.

Figure 20:
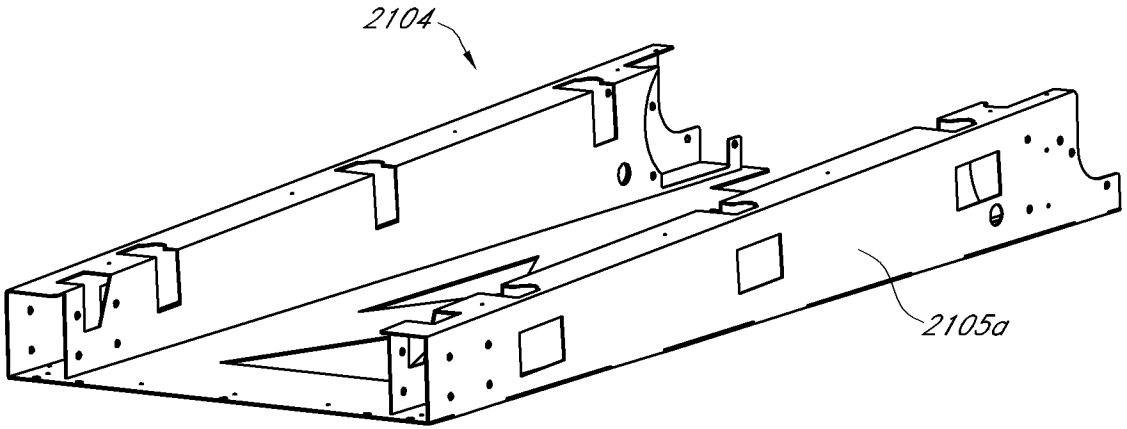
FIG. 20 illustrates another embodiment of a frame component that may be used with the various components of a treadmill disclosed herein.

In some embodiments the frame may have a wedge or inclined shape, such as the frame 2104 shown in FIG. 20. In this configuration, the back or rear end of the treadmill is at a lower elevation than the front or forward end of the treadmill. This allows the same diameter front roller and other front drive components as used with the frame shown in FIGS. 2 and 3 to be used with the frame shown in FIG. 20. The frame 2104 may include all of the slotted openings, cutouts, and features discussed above with respect to frame 104 to allow for easy drop-in of treadmill components as described above. Additional advantages of the wedge-frame 2104 include reducing the step up height for a user to step onto the treadmill belt. This allows the treadmill to be more easily used by those users who may have difficulty stepping up onto the treadmill deck. Furthermore, the lower rear height of the treadmill reduces the distance to the ground to potentially reduce the risk of injury should a user fall off the rear of the treadmill during operation.

An additional advantage of the wedge-shaped frame 2104 is the assistance the slight incline provides in initiating motion of the treadmill belt. As the user will be walking up a slight incline from the first step on the treadmill, it will be easier for the user to initiate motion of the treadmill belt using the initial steps on the belt.

The wedge-frame 2104 allows use of the same diameter front roller 120 as discussed above such that performance of the treadmill is not impacted. In some embodiments, a smaller diameter rear roller may be used without impacting the feel and performance of the treadmill.

Figure 22:
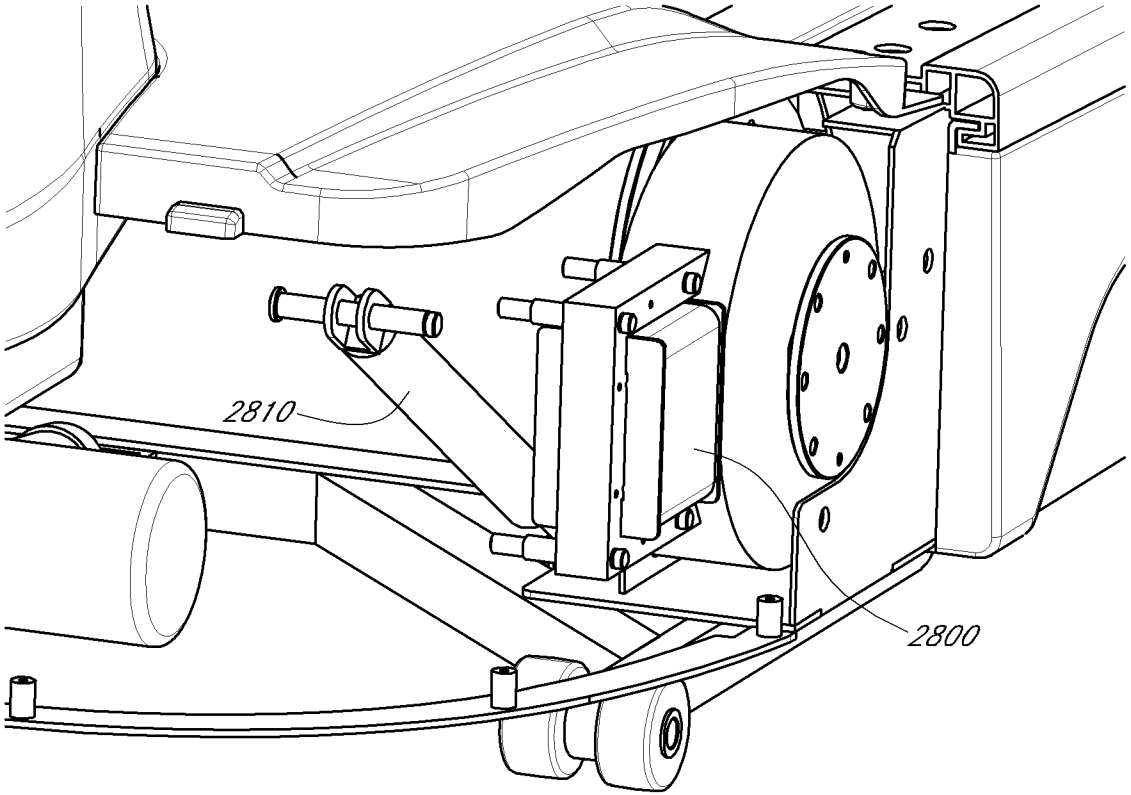
FIG. 22 illustrates an eddy current generator and assisted lift system for use with any of the treadmills disclosed herein.
Figure 23:
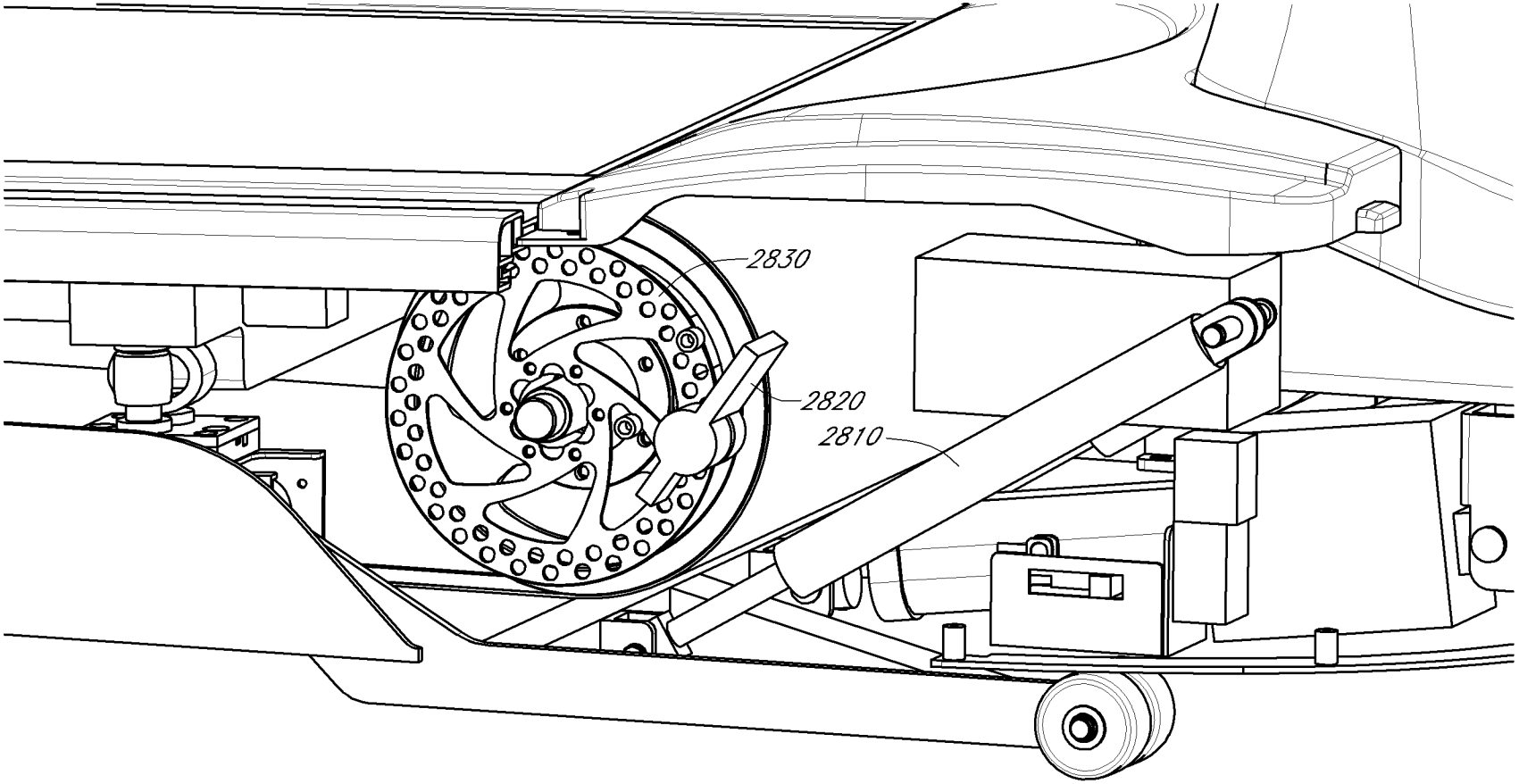
FIG. 23 illustrates a mechanical braking system for use with any of the treadmills disclosed herein.

In some configurations, a linear actuator or lift motor can be used to raise the front of the treadmill to the desired incline. However, a linear actuator or lift motor consumes a lot of power and is the largest consumer of power for the self-propelled treadmill disclosed herein. When the treadmill is not operating, that is, when a user is not walking or running on the treadmill to generate electricity, the lift motor will require power from the battery to move the treadmill to the desired incline. To achieve the desired treadmill elevation, the lift motor needs to be powerful enough to overcome the user's weight as well as the weight of the treadmill frame and components. To reduce power consumption, some embodiments of the self-propelled treadmill include a lift assist system as shown in FIGS. 22 and 23. The lift assist system can include a pair of gas springs 2810 that can provide leverage assistance and reduce the amount of power consumed by the lift motor by reducing the amount of work required of the lift motor. In a normal incline operation, the lift motor can lift around 10 or 20 lbs. However, in some embodiments, the lift motor can lift 30, 40, 50, 60, 70, 80 or 100 lbs. In some embodiments, the lift motor can lift up to 150 lbs. In some embodiments, the gas springs 2810 can lift 10, 20, 30, 40, 50, 60, 70, 80, 90, or 100 lbs. In some embodiments, each of the gas springs 2810 can lift up to 150 lbs. The gas springs 2810 may be connected to a stationary portion of the support structure and to the frame on opposite sides of the treadmill deck at the front of the treadmill. When a user desires an elevation change, the gas springs 2810 provide additional force to lift the treadmill frame, therefore reducing the power consumption of the lift motor. In some embodiments, the lift motor provides specific control to achieve the desired incline, that is, the lift motor controls the demanded lift provided by the gas springs 2810.

Variable Impact Absorption System

One embodiment of a variable impact absorption system includes one or more adjustable dampers (hydraulic or air cylinders or any other type of damping system), one or more infrared sensors, and a control system. The infrared sensors desirably measure the deflection of the treadmill deck for each user and based on the deflection the control system adjusts the stiffness such that the deflection of the treadmill deck is consistent whether the user weighs 90 lbs or 350 lbs, or any other weight.

The treadmill motion assembly 300 also includes components that may be used for variable impact absorption. The term "variable impact absorption" is a broad term having its ordinary meaning. In some embodiments, variable impact absorption or a variable impact absorption system refers to components that can measure the amount of deflection of the cartridge or deck due to a user's weight or the force of impact of a user's foot while running or walking on the treadmill and adjust an amount of absorption to reduce or control the amount of deck deflection, provide a desired cushioning or feel, and/or calculate a user's weight or force of impact for use in other treadmill functions, such as calculations of calories burned, etc. The variable impact absorption system includes a plurality of impact absorption members, actuators, and sensors connected to a control system that measure the amount of deflection of the treadmill deck as the user walks or runs on the treadmill. Additionally, the variable impact absorption system, via the control system, can communicate with an energy generation system including the integrated flywheel generator discussed below to establish an initial gearing ratio of the transmission of the treadmill such that users of different weights can start and stop the motion of the treadmill belt with equal force such that the resultant initial motion of the belt is smooth and controlled.

As illustrated in FIG. 3, six impact absorption members 310, 318, 322, 326, 332, 340 may be used with the treadmill 100, with three impact absorption members on each side of the treadmill belt 110 and equally distributed along the length of the treadmill belt 110. Each impact absorption member may include a pair of spring members 308, 316, 320, 324, 330, 338. The spring members 308, 316, 320, 324, 330, 338 may be formed from an elastomeric polymer and may be attached to a mounting member 309, 317, 321, 325, 331, 339 using any type of mechanical fastener including screws, nails, brads, etc. In other embodiments, the spring members may be hydraulic dampers, compressed air dampers, or any other type of damper. In some embodiments, the spring members 308, 316, 320, 324, 330, 338 may include one or more sets of dampeners (e.g., gbr dampeners, or other type of dampeners). The dampeners may be characterized by a force over travel ratio. One of the sets of dampeners may be mounted lower than the mounting height of the cartridge. One set of the dampeners is preferably always engaged when a user is on the treadmill. The set of dampeners mounted lower will engage when more force is applied to running or walking surface of the treadmill. As force is applied, the second (lower) set of dampeners engages, changing the dampening effect.

Additionally, a pair of variable impact absorption members 314, 328 may be used with the treadmill 100. Variable impact absorption member 314 may be located on the right side of the treadmill belt 110 while the other variable impact absorption member 328 may be located on the left side of the treadmill belt 110. The variable impact absorption members 314, 328 may be air operated cylinders to provide adjustable absorption of impact on the treadmill due to the force of the user's steps while walking or running. Each of the variable impact absorption members 314, 328 may be placed underneath an impact support member 312, 342. The impact support members 312, 342 may be rectangular support members that are supported on each end by an impact absorption member. As illustrated in FIG. 3, the variable impact absorption members 314, 328 are desirably centered underneath the impact support members 312, 342. The variable impact absorption system may also include additional actuators 334, 336 to provide additional impact absorption.

Figure 5:
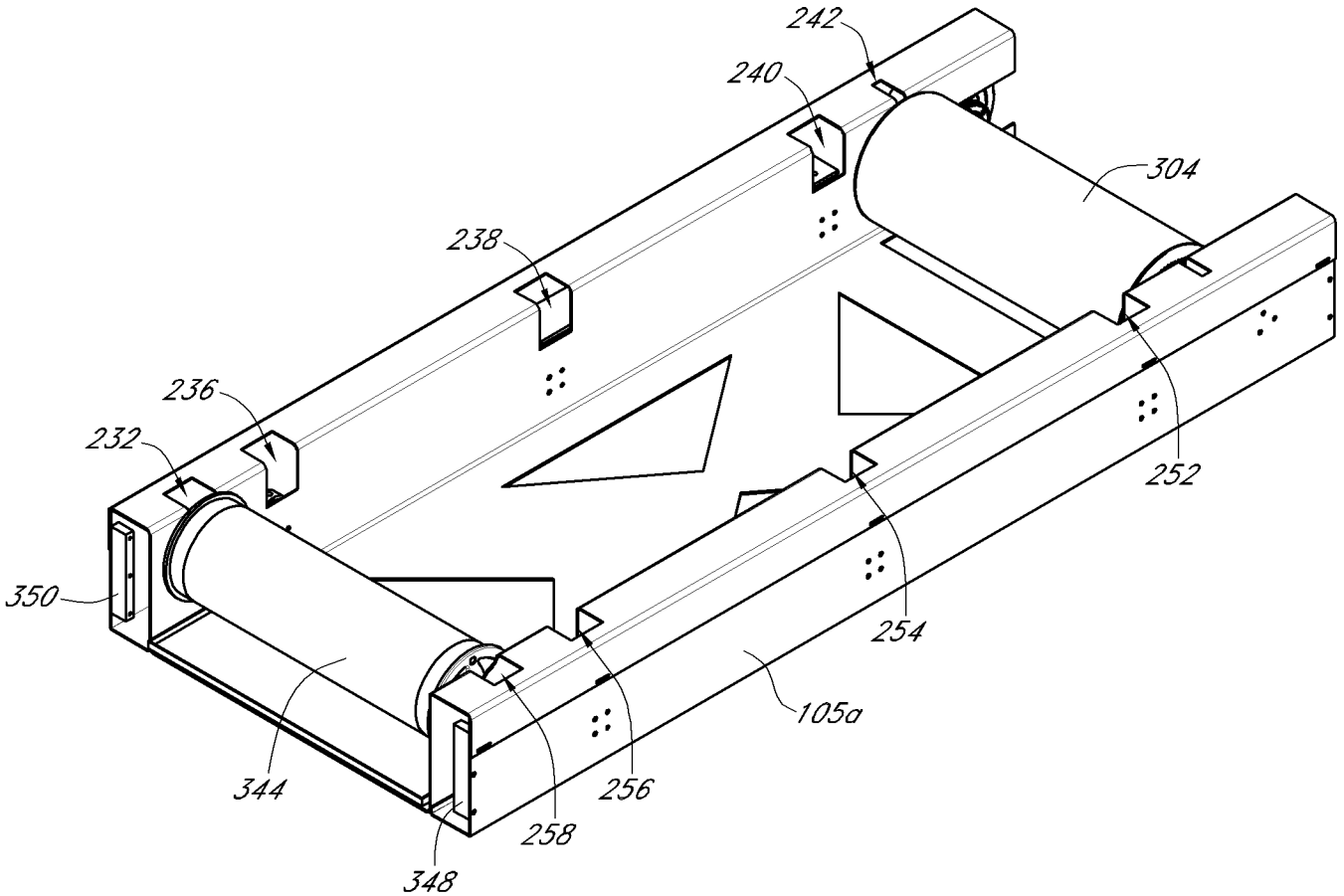
FIG. 5 illustrates another embodiment of treadmill rollers and impact absorption components installed in a treadmill frame component.
Figure 16:
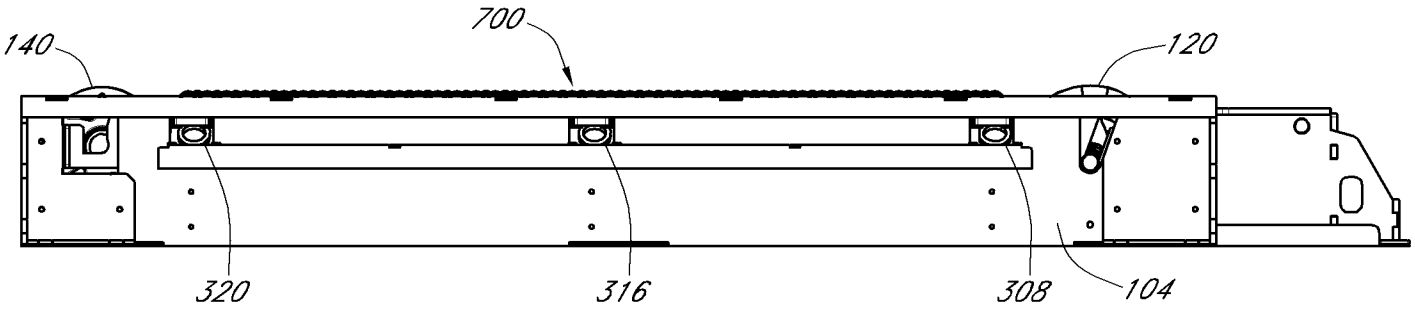
FIG. 16 illustrates a side view of the treadmill shown in FIG. 15.
Figure 17:
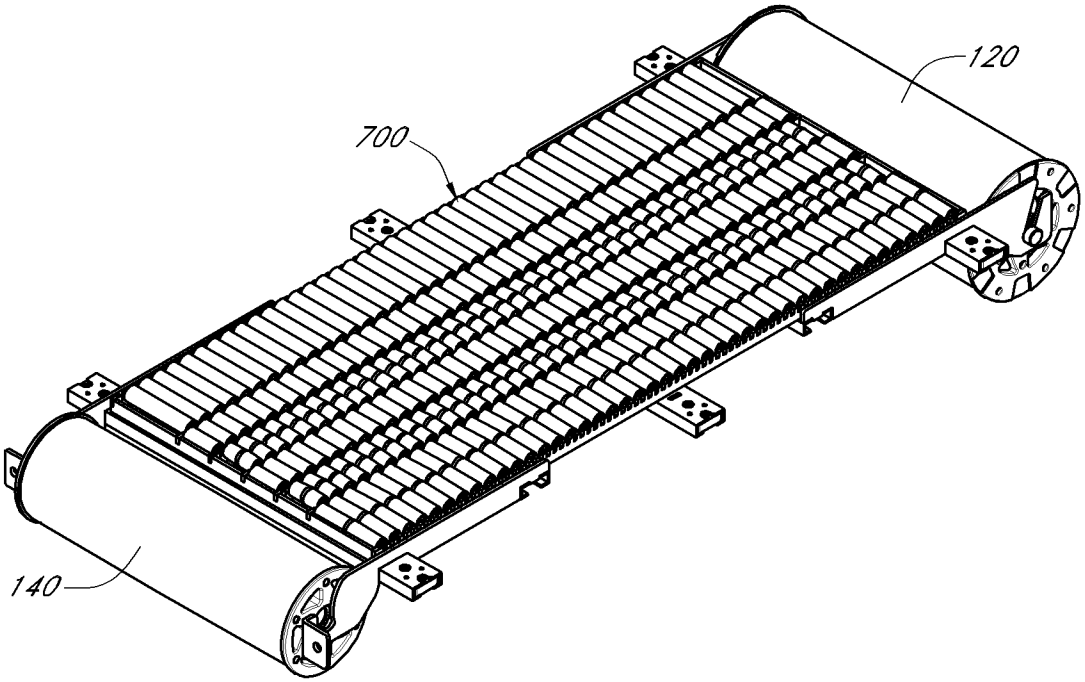
FIG. 17 illustrates belt tensioning rollers and a cartridge assembly for the treadmill shown in FIG. 14.

FIG. 4 illustrates the treadmill components 300 discussed above in their relative positions when installed in the frame 104. As discussed above, the front roller 304 is slotted into the front of the frame 104 in the slotted openings 242, 250. The axis of the rear roller 344 fits within the openings 232, 258 in the frame 104. The six impact absorption members 310, 318, 322, 326, 332, 340 are desirably equally distributed on either side of the frame 104 outside of the channel formed by the frame 104. Desirably, each of the six impact absorption members 310, 318, 322, 326, 332, 340 is aligned with one of the openings 236, 238, 240, 252, 254, 256. Preferably, the openings 236, 238, 240, 252, 254, 256 are configured such that cartridge support members 702, 704, 706 (FIG. 7) fit within the openings 236, 238, 240, 252, 254, 256 and each end of the cartridge support members 702, 704, 706 is supported by one of the six impact absorption members 310, 318, 322, 326, 332, 340. In some embodiments, as shown in FIG. 5, side support members 105*a*, 105*b* may be connected to the frame 104 such that the variable impact absorption system components are enclosed and protected. A fully assembled treadmill deck with front and rear rollers, frame 104, and side support members 105*a*, 105*b* enclosing the variable impact absorption system components is shown in FIG. 6. FIG. 16 illustrates a side view of another embodiment of a cordless treadmill 100 including dampeners 308, 316, 320 that may be arranged as discussed above to provide variable impact absorption.

Cartridge

Figure 7:
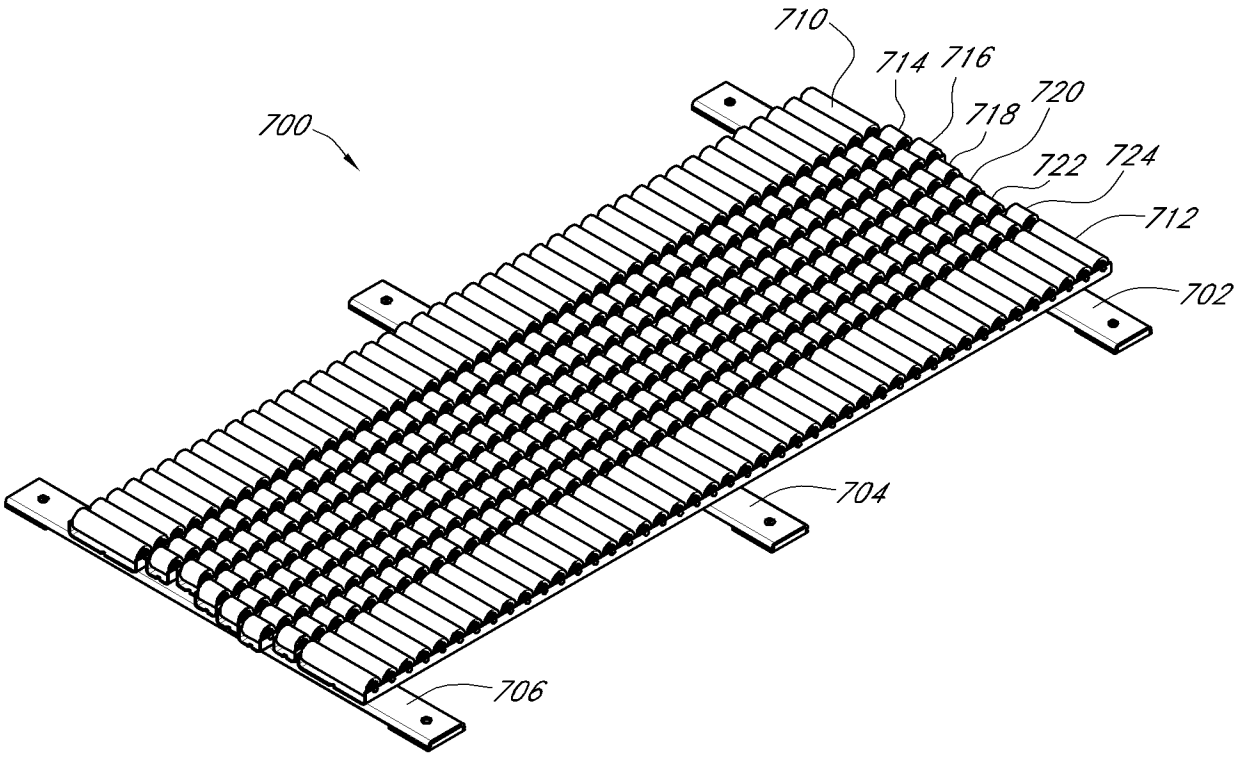
FIG. 7 illustrates a cartridge with staggered rollers for a treadmill, according to one embodiment.
Figure 8:
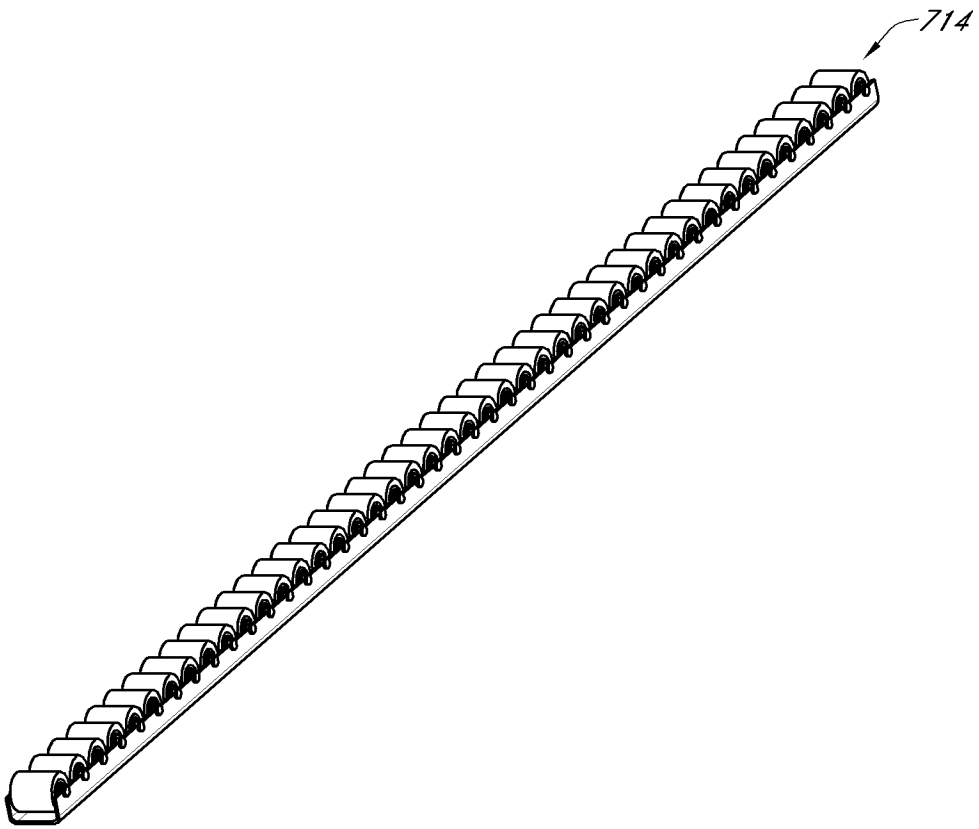
FIG. 8 illustrates one assembly of the staggered rollers that comprises part of the cartridge assembly shown in FIG. 7.

The treadmill may include a cartridge assembly composed of staggered and non-staggered rollers that may be dropped into the frame 104. A cartridge assembly (e.g., instead of a standard treadmill deck) can desirably be dropped into the frame 104 during assembly, reducing assembly time. The cartridge assembly illustrated in FIG. 7 incorporates a staggered pattern of wheels (sometimes referred to as mini-wheels) or rollers assembled with bearings. As illustrated in FIG. 7, the cartridge assembly 700 includes six staggered roller sets 714, 716, 718, 720, 722, and 724. The staggered roller sets 714, 716, 718, 720, 722, and 724 may each be identical and include a plurality of rollers set in a common trough or channel. One example of a single channel of a set of staggered rollers is shown in FIG. 8. Multiple troughs of the rollers shown in FIG. 8 may be offset and placed side by side on the center portion or deck of the treadmill 100 to form the main running or walking surface of the treadmill 100 as illustrated in FIG. 7. The staggered wheels or roller sets 714, 716, 718, 720, 722, and 724 are located on the center portion of the cartridge and preferably extend approximately 18" of the total width of the cartridge assembly 700. The staggered wheel pattern allows the user to have a constant surface contact underfoot while using the treadmill.

Figure 9:
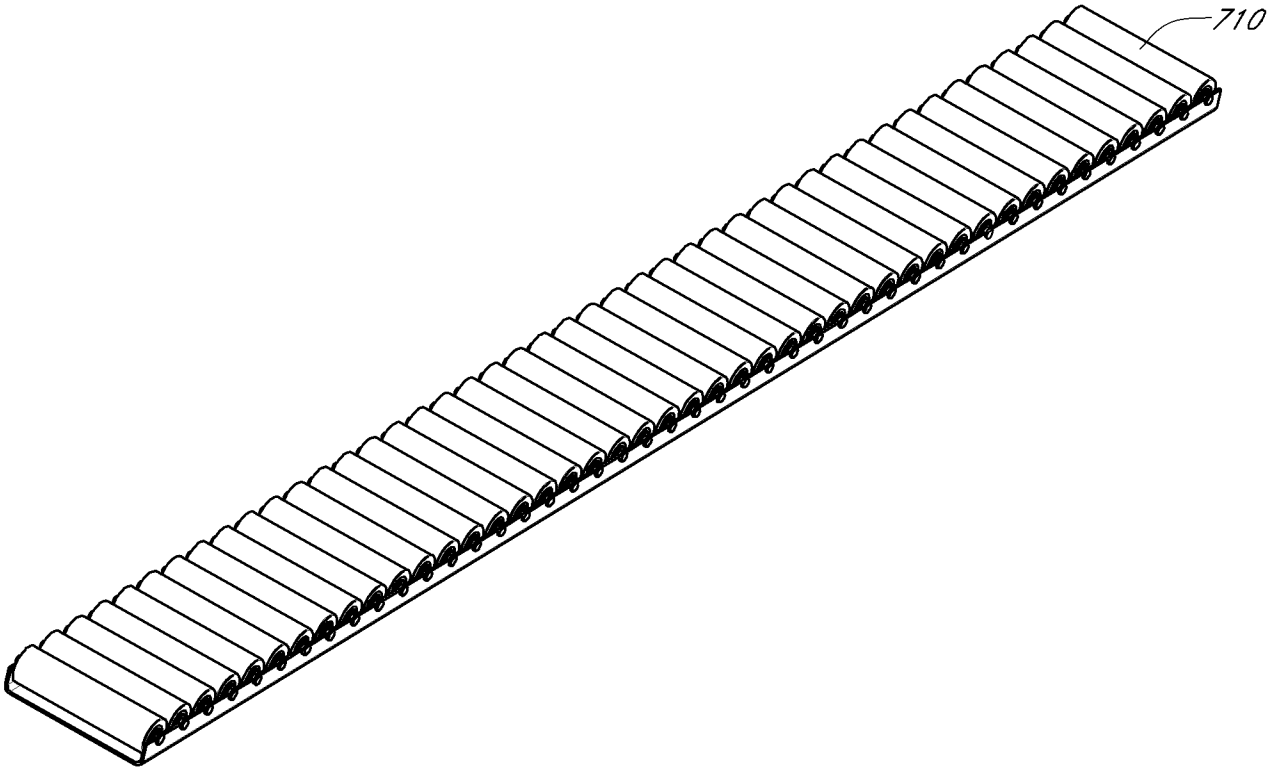
FIG. 9 illustrates one assembly of the collinear rollers that comprises part of the cartridge assembly shown in FIG. 7.

In one embodiment, as shown in FIG. 7, the cartridge assembly 700 further includes a first collinear roller channel 710 and a second collinear roller channel 712 located on the outside of or flanking the staggered roller sets 714, 716, 718, 720, 722, and 724. One example of a single channel of collinear rollers is shown in FIG. 9. The two outer channels of collinear rollers 710, 712 provide a bumpy, or vibration-feel experience for the user to guide the user to center their strides over the staggered wheel portion of the cartridge assembly 700. As illustrated in FIG. 6, a traditional treadmill belt travels around the outside of the cartridge assembly 700 to provide the running or walking surface. In some embodiments, each of the staggered wheels or rollers that make up the staggered roller sets 714, 716, 718, 720, 722, and 724 have a diameter between 1"-1.5".

Figure 18:
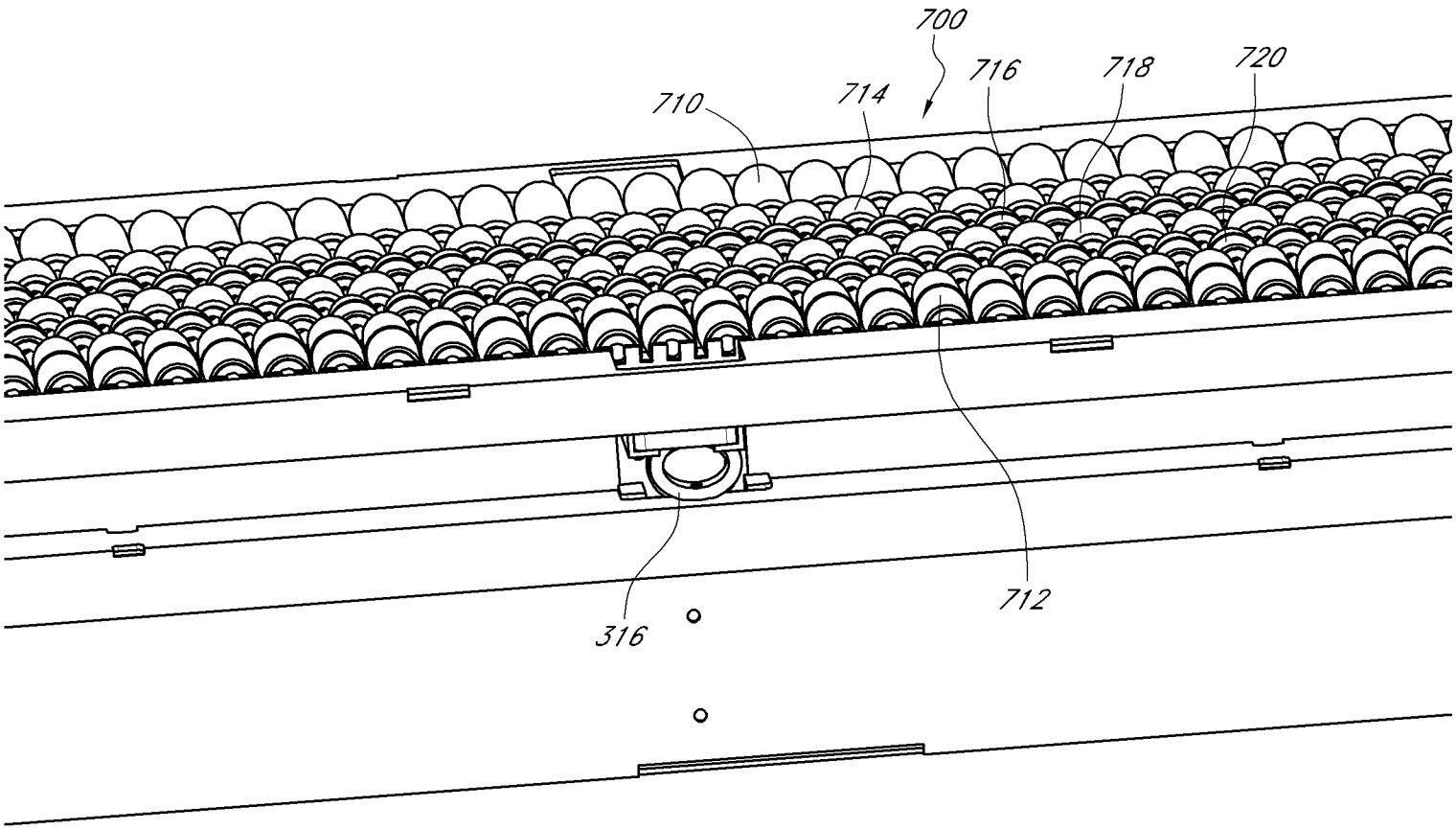
FIG. 18 illustrates an enlarged side view of the cartridge assembly and an impact absorption member for the treadmill shown in FIG. 14.

The cartridge assembly 700 can provide feedback to the user to guide the user to center the running or walking strides on the center, staggered wheel portion of the cartridge assembly 700. For example, as the user walks or runs on the treadmill 100, the user will desirably place each step on the staggered wheel sets 714, 716, 718, 720, 722, and 724 of the cartridge assembly 700. Due to the staggered design, the user will not feel any bumpiness or roughness to the surface. If the user steps too far to the right or left, the user will place his or her foot on the collinear roller channels 710, 712. The collinear design of the roller channels 710, 712 will create a bumpy feel to the user. This will inform the user that the walking or running strides are not centered on the treadmill belt 110 or the cartridge assembly 700 and the user will therefore desirably alter his or her stride accordingly. A closer view of another embodiment of the cartridge assembly 700 is shown in FIG. 18. As illustrated, the staggered rollers 714, 716, 718, 720 are configured such that the centers of each roller are offset from the adjacent rollers. As discussed above, this provides a smooth surface for the user. Additionally, the collinear rollers 710 and 712 are configured such that they flank the sets of staggered rollers such that the collinear rollers 710, 712 extend longitudinally at the exterior side edges of the treadmill deck. As illustrated, the collinear roller sets 710, 712 may be formed from one roller or from two or more rollers that are configured such that their centers are aligned (see rollers 712). In the illustrated embodiment, the collinear rollers 710, 712 are arranged such that the centers of the collinear rollers 710, 712 are not aligned with the centers of the adjacent staggered rollers, as illustrated in FIG. 18.

An additional benefit provided by the cartridge assembly 700 shown in FIG. 7 is a reduced loss of energy. The cartridge assembly 700 with the pattern of staggered roller sets 714, 716, 718, 720, 722, and 724 provide constant contact with the treadmill belt 110 as the belt 100 rotates around the cartridge assembly 700 during use. The constant contact between the treadmill belt 110 and the cartridge assembly 700 allows for more efficient energy transfer to the energy generation system discussed below due to reduced energy losses in addition to the smooth and comfortable feel of the treadmill to the user.

As further illustrated in FIG. 7 and discussed above with respect to FIGS. 5 and 6, the cartridge assembly 700 also includes a plurality of laterally extending support members 702, 704, 706. Each of the support members is connected to the channels of the roller sets 710, 712, 714, 716, 718, 720, 722, 724 by any type of mechanical fastener. The support members 702, 704, 706 extend laterally beyond the edges of each of the collinear roller channels 710, 712 such that the ends of each of the support members 702, 704, 706 may slot into the openings 236, 238, 240, 252, 254, 256 of the frame 104 (FIG. 5). To illustrate, the cartridge assembly 700 shown in FIG. 7 can drop into the frame 104, shown in FIGS. 5 and 6, and due to gravity and the weight of the cartridge assembly 700, requires minimal or no securing devices to hold it together. The laterally-extending tabs of the cartridge slide into the tab receptacles on each side of the frame, securing the cartridge from forward and backward motion. As discussed above, each of the ends of the support members 702, 704, 706 rest on one of the six impact absorption members 310, 318, 322, 326, 332, 340 such that movement of the cartridge assembly 700 due to the force of impact of a user's foot during walking or running is damped by the absorption members 310, 318, 322, 326, 332, 340.

Figure 15:
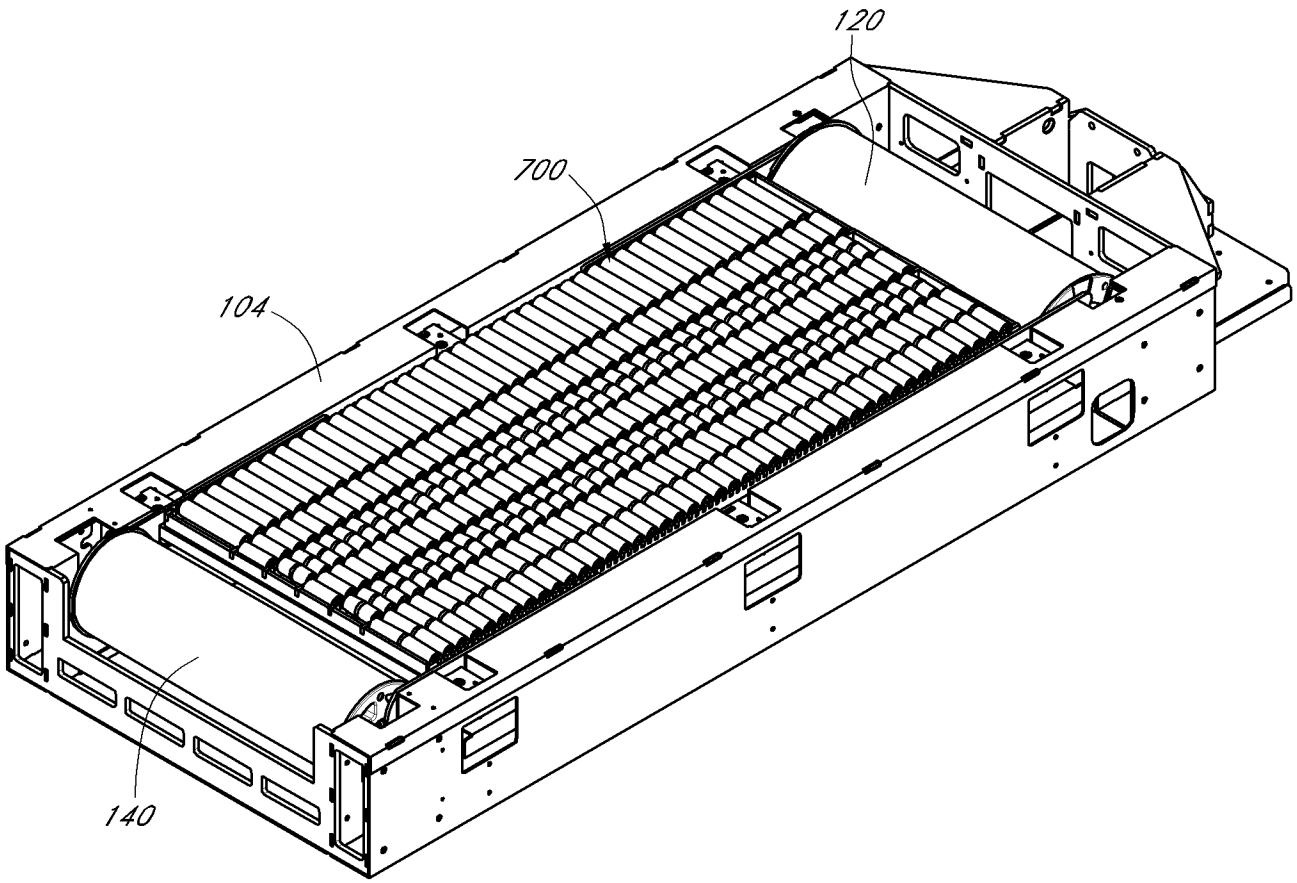
FIG. 15 illustrates belt tensioning rollers, impact absorption components, and a flywheel generator assembly installed in a frame assembly for the cordless treadmill shown in FIG. 14, according to one embodiment.

In another embodiment of a user-propelled treadmill, as illustrated in FIG. 15, the cartridge assembly 700 comprising a plurality of sets of staggered rollers flanked on either side by a set of collinear rollers may be configured to move together with the front roller assembly 120 and rear roller assembly 140. All three of the components (cartridge assembly 700, front roller assembly 120, and rear roller assembly 140) may drop into the frame component 104 as discussed above for ease of assembly. Additionally, as the user is using the treadmill, the cartridge assembly 700 and front and rear roller assemblies 120, 140 move together left and right. In other embodiments, as shown in FIGS. 4-7, the cartridge assembly 700 may be independent with the front roller assembly 120 fixed in position. Allowing the cartridge assembly 700, front roller assembly 120, and rear roller assembly 140 to move together provides the additional advantage of increasing the safety of the treadmill by improving the treadmill belt 110 tracking over the cartridge assembly 700, front roller assembly 120, and rear roller assembly 140.

Another embodiment of a user-propelled treadmill is illustrated in FIG. 19. Similar to the treadmill shown in FIGS. 1-7 and discussed above, the treadmill 2100 includes a cartridge assembly 2700 comprising a plurality of sets of staggered rollers. In the embodiment illustrated in FIG. 19, the sets of rollers are staggered such that the longitudinal axes of the rollers of the first and third columns (as measured from the left side of the treadmill when viewing the treadmill from behind) are aligned and the longitudinal axes of the second and fourth columns of rollers are also aligned but the longitudinal axes of the first and third columns and the second and fourth columns are staggered or offset. This assembly provides advantages in manufacturing and assembly while retaining the user feedback advantages identified above. In some embodiments, the cartridge assembly 2700 provides an additional benefit to the user in the form of foot therapy. As the user strides on the belt passing above the cartridge assembly, the motion of the rollers and treadmill belt cause a slight vibration that passes through the user's foot, stimulating the nerves on the bottom of the user's foot. This vibration simulates a more natural feeling under foot that is more similar to what a user would feel when walking on grass, gravel, etc. This vibration or sensation acts to stimulate the user's brain in a way that a traditional treadmill cannot, as the traditional treadmill provides a more static experience due to a belt passing over a solid deck. This awareness may reduce boredom and increase the user's awareness of sensations sensed by the foot, which may provide additional benefits for therapy users.

Integrated Flywheel Generator

Unlike an electric treadmill that has a motor to turn the treadmill's belt, the belt of a cordless treadmill moves under the force of the user's gait. More force is required to start moving the cordless treadmill's belt than to maintain it in motion. The flywheel generator compensates for these different force requirements by initially decreasing resistance and subsequently increasing resistance once the treadmill's belt is in motion. This provides the user a smooth, controlled experience, similar to what would be experienced by using an electric treadmill.

The flywheel generator (FG) includes a gear system (a transmission) that can control the amount of resistance used to control the treadmill's belt's speed. Initially, the FG measures the user's weight and determines the appropriate gear ratio (i.e., which gear to engage) based upon the user's weight. The user's weight can be determined by any of a variety of techniques, including by using a scale, a resistor, a piston, a "variable impact absorption system" (as described below) or any other weight measurement technique.

The FG's initial gear selection assures that the user is able to smoothly initiate belt movement by walking on the belt, regardless of the user's weight. Without such dynamic gear selection, a heavier person may feel very little resistance, and the belt could possibly move too quickly and injure the user. Similarly, without such dynamic gear selection, a lighter person may feel too much resistance and it may be difficult or uncomfortable for the user to initiate belt rotation.

The integrated flywheel generator is a mechanism for powering the treadmill without requiring electricity. The integrated flywheel generator, along with the variable impact absorption system discussed above, incorporates a sensor (preferably an infrared sensor) to measure a user's weight (e.g., by measuring displacement of the variable impact absorption system or the deflection of the cartridge), select an appropriate "stiffness" of the variable impact absorption system and assign an appropriate gear ratio of the flywheel based on the measured weight so that the effort needed to start and maintain the rotation of the treadmill belt by the user is similar regardless of the user's weight. The treadmill provides the same feel and comfort, and works the same way for an individual regardless of his or her weight. For example, the treadmill will start and stop as responsively for a 90 lb. person as it would for a 350 lb. person.

Figure 10:
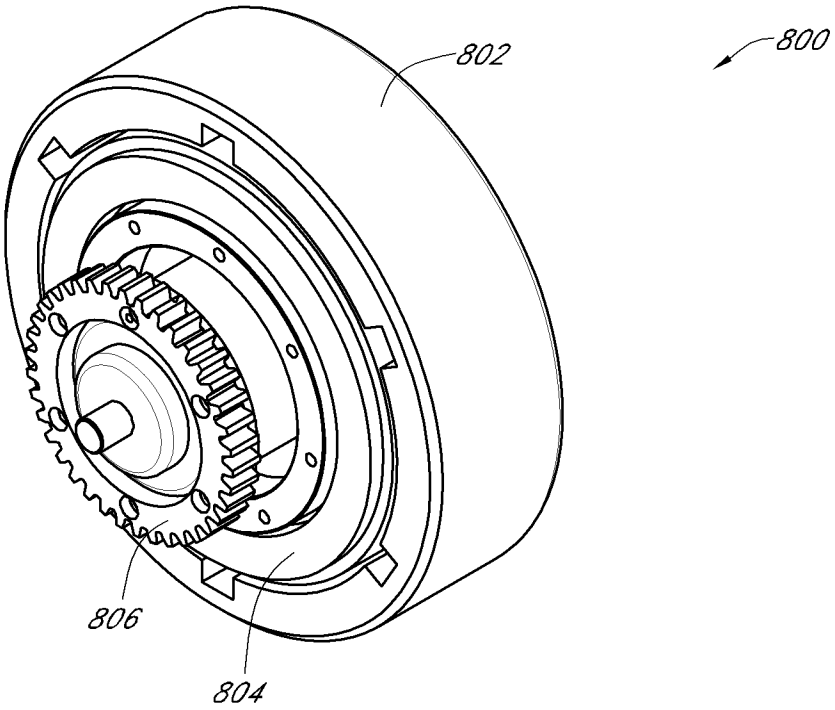
FIG. 10 illustrates a flywheel generator for a treadmill according to one embodiment.
Figure 11:
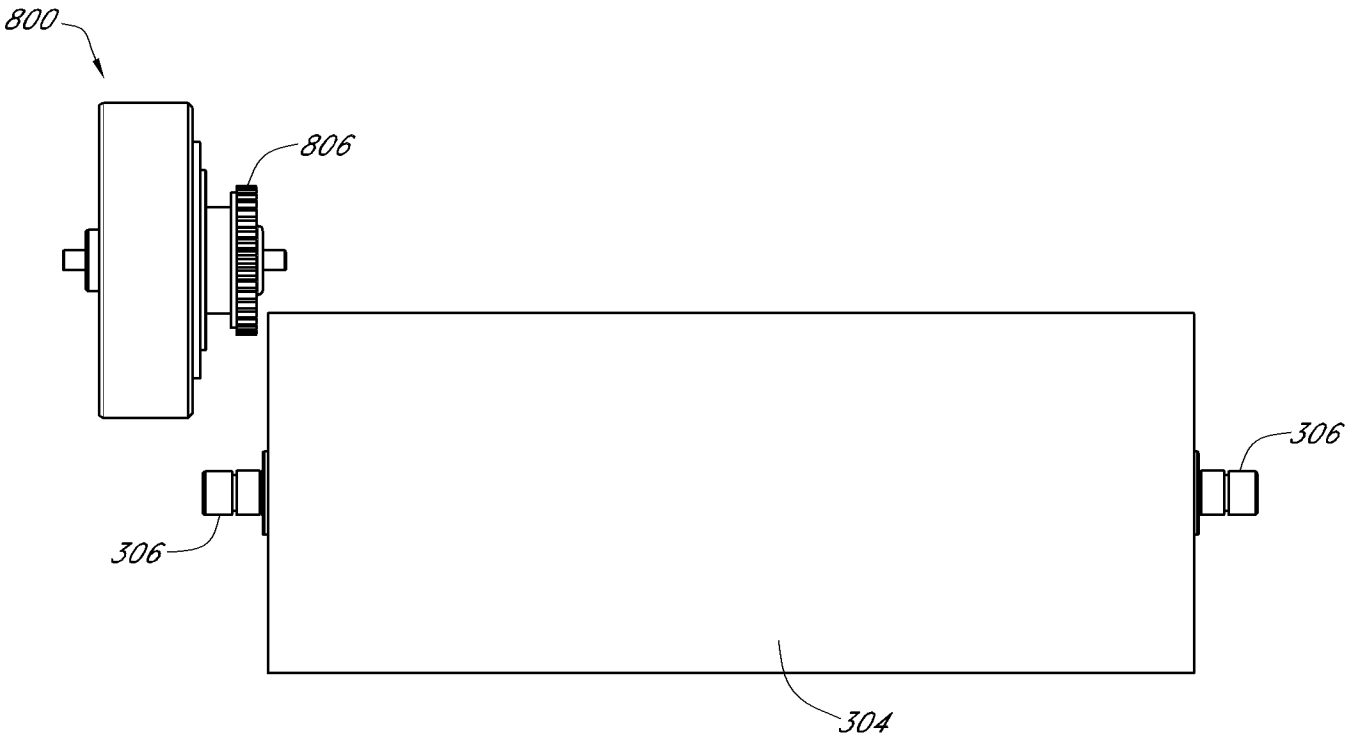
FIG. 11 illustrates the forward roller and a flywheel generator for the treadmill shown in FIG. 1, according to one embodiment.

The integrated flywheel generator includes an electrical generator for generating electricity from the rotational motion of the treadmill and a flywheel for storing the converted energy. In one embodiment, the integrated flywheel generator is preferably rotatably connected to the front roller 304 via a gearing system. As shown in FIG. 10, the integrated flywheel generator 800 includes a magnetic housing 802 enclosing a rotor 804. A rotor gear 806 is attached to the rotor 804 such that the rotor gear 806 rotates due to rotation of the front roller 304 caused by a user walking or running on the treadmill belt 110. FIG. 11 illustrates the front roller 304 rotatably connected to the flywheel generator 800 through a system of gears including, in one embodiment, an 84 tooth gear included in the front roller drive.

In some embodiments, the integrated flywheel generator further includes a 3 speed gear box. Gear ratios for the three speed gear box may be 1:1, 1.25:1, 1.375:1 in one embodiment. In one embodiment, the main driven gear 806 may be a 38-tooth gear. When the treadmill transmission is in first gear the overall fixed gear ratio is approximately 2.2:1. When the treadmill transmission is in second gear the overall fixed gear ratio is approximately 2.75:1 and when the treadmill transmission is in third gear the overall fixed gear ratio is approximately 3.0:1. In some embodiments, sufficient electricity may be generated by the generator and the flywheel effect such that a separate transmission to increase the rpm and change the rotational speed of the generator may not be needed.

In general, the larger the outer diameter of the flywheel generator, the more efficiently the generator can generate electricity. While, in some embodiments having a wedge frame, such as the embodiment shown in FIGS. 19 and 20, a reduced diameter rear roller may be used, the reduction in diameter of the rear roller does not significantly affect the performance and feel of the treadmill. For a self-propelled treadmill, in order to achieve smooth performance and operation, a large diameter, heavy front roller is needed. Furthermore, the heavy front roller is needed to spin the flywheel generate to maximize the efficiency of energy generation. Therefore, the rotating front roller and flywheel generator are rotating masses used to assist with the feel and operation of the treadmill. In some embodiments, the performance and feel of the treadmill having a wedge-frame can be similar to the feel of a treadmill having a front and rear roller with the same diameter. In some embodiments, the flywheel is a 5 lb flywheel having a 7 inch outer diameter (OD) that is used in conjunction with a 22 lb front roller having a 7.75 inch OD and a transmission having a gear ratio between 4:1 and 6:1. In other embodiments, the OD of the flywheel can be between 6 and 8 inches and can weigh 3 to 7 lbs. In other embodiments, the front roller can weigh between 20 and 25 lbs with an OD between 6 and 9 inches, and the transmission can have a gear ratio between 3:1 and 9:1.

In some embodiments, the integrated flywheel generator desirably provides a variable flywheel effect based on the difference between the available torque and the required torque. The available torque may be defined as a variable amount of torque produced by the treadmill depending on the incline setting of the treadmill and the user's weight, minus friction. The required torque may be defined as the energy needed to rotate the treadmill belt and begin operation of the treadmill. To achieve a smooth, consistent feel of operation for all users, incline settings, speed settings and weights, the flywheel effect may be varied depending on the selected gear ratio. The speed reduction of the generator may be electronically controlled to slow the treadmill speed. Additionally, in some embodiments, the generator may generate sufficient electricity to power the treadmill, including a display unit, such as the display unit 162 shown in FIG. 14.

In some embodiments, including the embodiment illustrated in FIGS. 14-17, the generator may be integrated inside the front roller assembly 120. Integration of the generator within the front roller assembly 120 may provide the additional benefits of improved ease of assembly and may eliminate the requirement for a separate gearing and gear box assembly.

Additionally, the front roller of the front roller assembly 120 may be configured with a predetermined weight and configuration to act as a flywheel itself. By allowing the front roller to act as a flywheel, the design may be simplified by eliminating the need for a separate flywheel while still achieving the desired flywheel effect.

Control of the variable flywheel effect is automatic. Sensors within the variable impact absorption system discussed above measure the amount of deck deflection which translates into a weight or impact on the treadmill. The control system, which desirably includes a processor, working memory, and memory containing processor-executable instructions or modules, can determine the amount of available torque and the required torque to operate the treadmill belt from the calculated weight. After obtaining the required weight, the control system can select the appropriate gear ratio for the treadmill.

The integrated flywheel generator can work with the variable impact absorption system to provide a smooth and consistent treadmill operation without loss of energy due to an overly stiff or overly soft treadmill deck, as determined by the treadmill deck deflection. The infrared sensors of the variable impact absorption system can measure the user's weight by measuring displacement of the treadmill deck. Based on the measured deflection, the incline setting of the treadmill, the speed of the belt rotation, and a calculated friction, the control system selects an appropriate "stiffness" of the variable impact absorption system and an appropriate gear ratio of the flywheel such that the effort needed to start and maintain rotation of the belt is consistent regardless of the user's weight. In some embodiments, an energy storage unit (e.g., a battery, capacitor, etc.) may be provided with any of the treadmills described herein to store electrical energy generated by the flywheel generator.

To maintain a constant rate of desired speed, some embodiments of the self-propelled treadmill incorporate a multifaceted method of speed control. In some embodiments, speed control of the treadmill can include eddy current braking. An eddy current system, such as the system 2800 shown in FIG. 22, like a conventional friction brake, is a device used to slow or stop a moving object by dissipating its kinetic energy as heat. However, unlike electro-mechanical brakes, in which the drag force used to stop the moving object is provided by friction between two surfaces pressed together, the drag force in an eddy current brake is an electromagnetic force between a magnet and a nearby conductive object in relative motion, due to eddy currents induced in the conductor through electromagnetic induction.

A conductive surface moving past a stationary magnet will have circular electric currents called eddy currents induced in it by the magnetic field. The circulating currents will create their own magnetic field which opposes the field of the magnet. Thus the moving conductor will experience a drag force from the magnet that opposes its motion, proportional to its velocity. The electrical energy of the eddy currents is dissipated as heat due to the electrical resistance of the conductor.

Another advantage of eddy current braking is that since the brake does not work by friction, there are no brake shoe surfaces to wear out, necessitating replacement, as with friction brakes. A disadvantage of eddy current braking is that since the braking force is proportional to velocity, the brake has no holding force when the moving object is stationary, as is provided by static friction in a friction brake. An eddy current brake can be used to stop rotation of the treadmill belt quickly when power is turned off or another indication is received by the control system to stop the treadmill (such as detecting a user in an area outside the main running surface, etc.). However, when the treadmill is stationary, other speed control methods, such as resistive braking and frictional braking, described below, may be used.

The selection of the material of the flywheel has a strong relationship to the efficiency of the eddy current braking system. For example, a flywheel made of a more conductive material such as a copper, aluminum, or steel rotating at a high speed with high input voltage can improve the performance of the eddy current braking. However, at low speeds very little electrical energy is generated by the flywheel generator and the eddy current braking system may not be sufficient to control the speed of the treadmill belt.

In cases where eddy current braking is insufficient to control the speed of the treadmill, other types of control may be used. In some embodiments, resistive braking using high power resistors in line with the output of the generator can be used to control the treadmill speed. The resistors "resist" the energy flow of the generator causing a slowing effect of the generator that in turn slows the speed of the treadmill. To increase the speed of the generator, resistance is removed or decreased.

In cases where both resistive and eddy current braking are insufficient to slow the treadmill, or at other times when treadmill speed control is desired, such as in response to an automatic stop command, friction braking may be used along with one or more of eddy current and resistive braking or in lieu of one or more of the other control methods. Mechanical friction may be applied to slow or stop rotation of the front roller or flywheel through the application of hydraulic pressure via brake pads to a hard steel disc, as shown in FIG. 23. The frictional brake 2820 acts on the wheel 2830 in response to an instruction received from the control system to slow or stop the treadmill. Any type of frictional or mechanical brake may be used, including mountain bike disc brakes, etc. The brake pad 2820 may be made from any material such as ceramic, steep, bimetal, or in combination thereof.

Flywheel Generator System Overview

Figure 12:
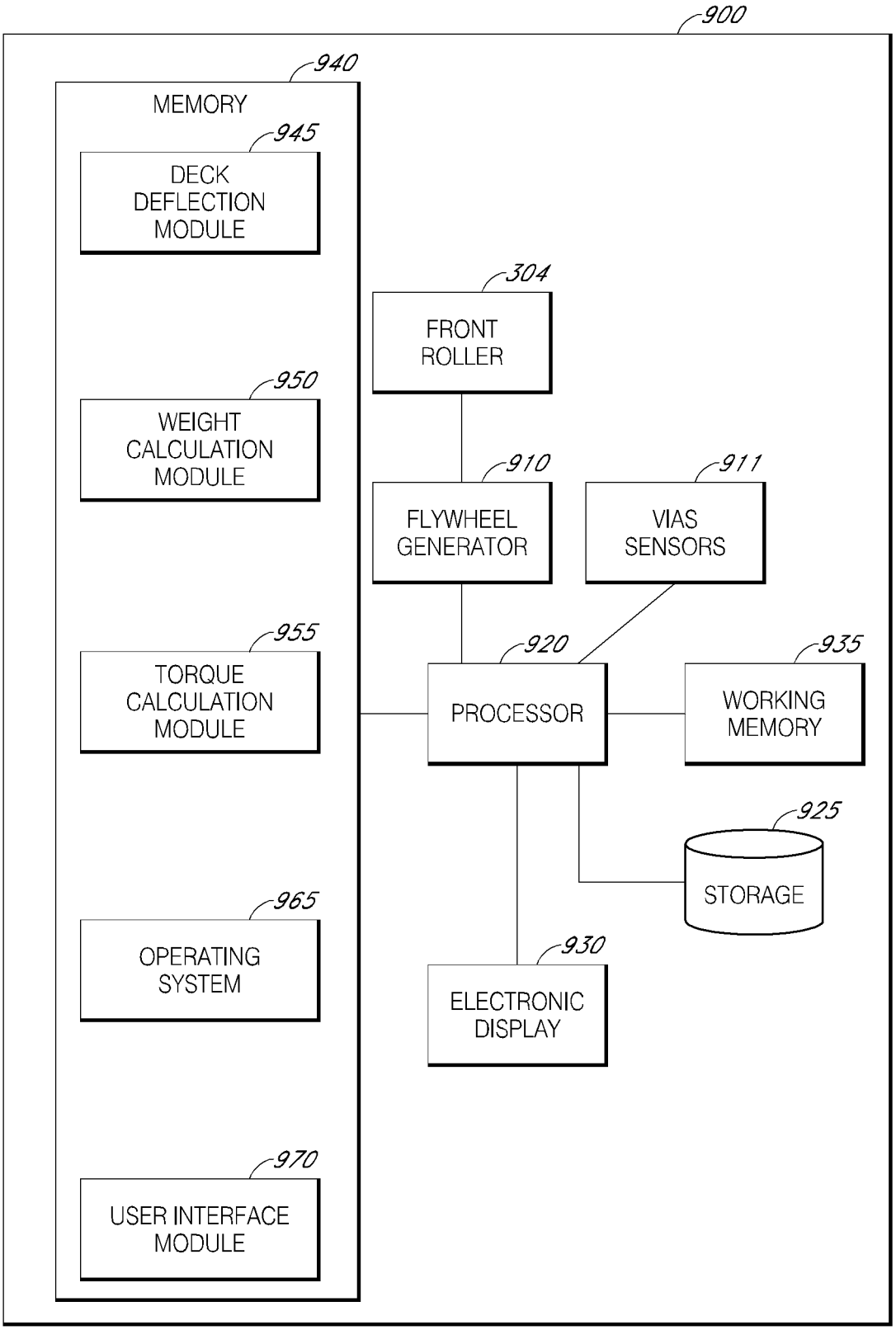
FIG. 12 is a block diagram depicting a system implementing some operative elements for control of a cordless treadmill.

FIG. 12 illustrates one example of a control system 900 configured to operate a cordless treadmill with electricity generated by the operation of the treadmill by a user. The illustrated embodiment is not meant to be limiting, but is rather illustrative of certain components in some embodiments. System 900 may include a variety of other components for other functions which are not shown for clarity of the illustrated components.

The system 900 may include a flywheel generator 910, a plurality of variable impact absorption system (VIAS) sensors 911, and an electronic display 930. Certain embodiments of electronic display 930 may be any flat panel display technology, for example an LED, LCD, plasma, or projection screen. Electronic display 930 may be coupled to the processor 920 for receiving information for visual display to a user. Such information may include, but is not limited to, visual representations of files stored in a memory location, software applications installed on the processor 920, user interfaces, and network-accessible content objects.

The system 900 may include may employ one or a combination of sensors 911, such as infrared sensors. The system 900 can further include a processor 920 in communication with the sensors 911 and the flywheel generator 910. A working memory 935, electronic display 930, and program memory 940 are also in communication with processor 920.

In some embodiments, the processor 920 is specially designed for treadmill operations. As shown, the processor 920 is in data communication with, program memory 940 and a working memory 935. In some embodiments, the working memory 935 may be incorporated in the processor 920, for example, cache memory. The working memory 935 may also be a component separate from the processor 920 and coupled to the processor 920, for example, one or more RAM or DRAM components. In other words, although FIG. 12 illustrates two memory components, including memory component 940 comprising several modules and a separate memory 935 comprising a working memory, one with skill in the art would recognize several embodiments utilizing different memory architectures. For example, a design may utilize ROM or static RAM memory for the storage of processor instructions implementing the modules contained in memory 940. The processor instructions may then be loaded into RAM to facilitate execution by the processor. For example, working memory 935 may be a RAM memory, with instructions loaded into working memory 935 before execution by the processor 920.

In the illustrated embodiment, the program memory 940 includes a deck deflection measurement module 945, a weight calculation module 950, a torque calculation module 955, operating system 965, and a user interface module 970. These modules may include instructions that configure the processor 920 to perform various processing and device management tasks. Program memory 940 can be any suitable computer-readable storage medium, for example a non-transitory storage medium. Working memory 935 may be used by processor 920 to store a working set of processor instructions contained in the modules of memory 940. Alternatively, working memory 935 may also be used by processor 920 to store dynamic data created during the operation of treadmill system 900.

As mentioned above, the processor 920 may be configured by several modules stored in the memory 940. In other words, the process 920 can execute instructions stored in modules in the memory 940. Deck deflection module 945 may include instructions that configure the processor 920 to obtain deck deflection measurements from the VIAS sensors 911. Therefore, processor 920, along with deck deflection module 945, VIAS sensors 911, and working memory 935, represent one technique for obtaining deck deflection data.

Still referring to FIG. 12, memory 940 may also contain weight calculation module 950. The weight calculation module 950 may include instructions that configure the processor 920 to calculate a weight of a user based on the measured deck deflection. Therefore, processor 920, along with weight calculation module 950, and working memory 935, represents one means for calculating a treadmill user's weight.

Memory 140 may also contain torque calculation module 955. The torque calculation module 955 may include instructions that configure the processor 920 to calculate the available torque and required torque of the treadmill from the weight calculation determined from the measured deck deflection. For example, the processor 920 may be instructed by the torque calculation module 955 to calculate the available torque and the required torque and store the calculated torques in the working memory 935 or storage device 925. Therefore, processor 920, along with weight calculation module 950, torque calculation module 955, and working memory 935 represent one means for calculating and storing torque calculations.

Memory 940 may also contain user interface module 970. The user interface module 970 illustrated in FIG. 12 may include instructions that configure the processor 920 to provide a collection of on-display objects and soft controls that allow the user to interact with the device. The user interface module 970 also allows applications to interact with the rest of the system. An operating system module 965 may also reside in memory 940 and operate with processor 920 to manage the memory and processing resources of the system 900. For example, operating system 965 may include device drivers to manage hardware resources for example the electronic display 930 or sensors 911. In some embodiments, instructions contained in the deck deflection module 945, weight calculation module 950 and torque calculation module 955 may not interact with these hardware resources directly, but instead interact through standard subroutines or APIs located in operating system 965. Instructions within operating system 965 may then interact directly with these hardware components.

Processor 920 may write data to storage module 925. Storage module 925 may include either a disk-based storage device or one of several other types of storage mediums, including a memory disk, USB drive, flash drive, remotely connected storage medium, virtual disk driver, or the like.

Although FIG. 12 depicts a device comprising separate components to include a processor, sensors, electronic display, and memory, one skilled in the art would recognize that these separate components may be combined in a variety of ways to achieve particular design objectives. For example, in an alternative embodiment, the memory components may be combined with processor components to save cost and improve performance.

Additionally, although FIG. 12 illustrates two memory components, including memory component 940 comprising several modules and a separate memory 935 comprising a working memory, one with skill in the art would recognize several embodiments utilizing different memory architectures. For example, a design may utilize ROM or static RAM memory for the storage of processor instructions implementing the modules contained in memory 940. Alternatively, processor instructions may be read at system startup from a disk storage device that is integrated into system 100 or connected via an external device port. The processor instructions may then be loaded into RAM to facilitate execution by the processor. For example, working memory 935 may be a RAM memory, with instructions loaded into working memory 935 before execution by the processor 920.

Gear Ratio Control Process

Embodiments of the invention relate to a process for automatically determining a gear ratio for operation of a cordless treadmill. The examples may be described as a process, which is depicted as a flowchart, a flow diagram, a finite state diagram, a structure diagram, or a block diagram. Although a flowchart may describe the operations as a sequential process, many of the operations can be performed in parallel, or concurrently, and the process can be repeated. In addition, the order of the operations may be re-arranged. A process is terminated when its operations are completed. A process may correspond to a method, a function, a procedure, a subroutine, a subprogram, etc. When a process corresponds to a software function, its termination corresponds to a return of the function to the calling function or the main function.

Figure 13:
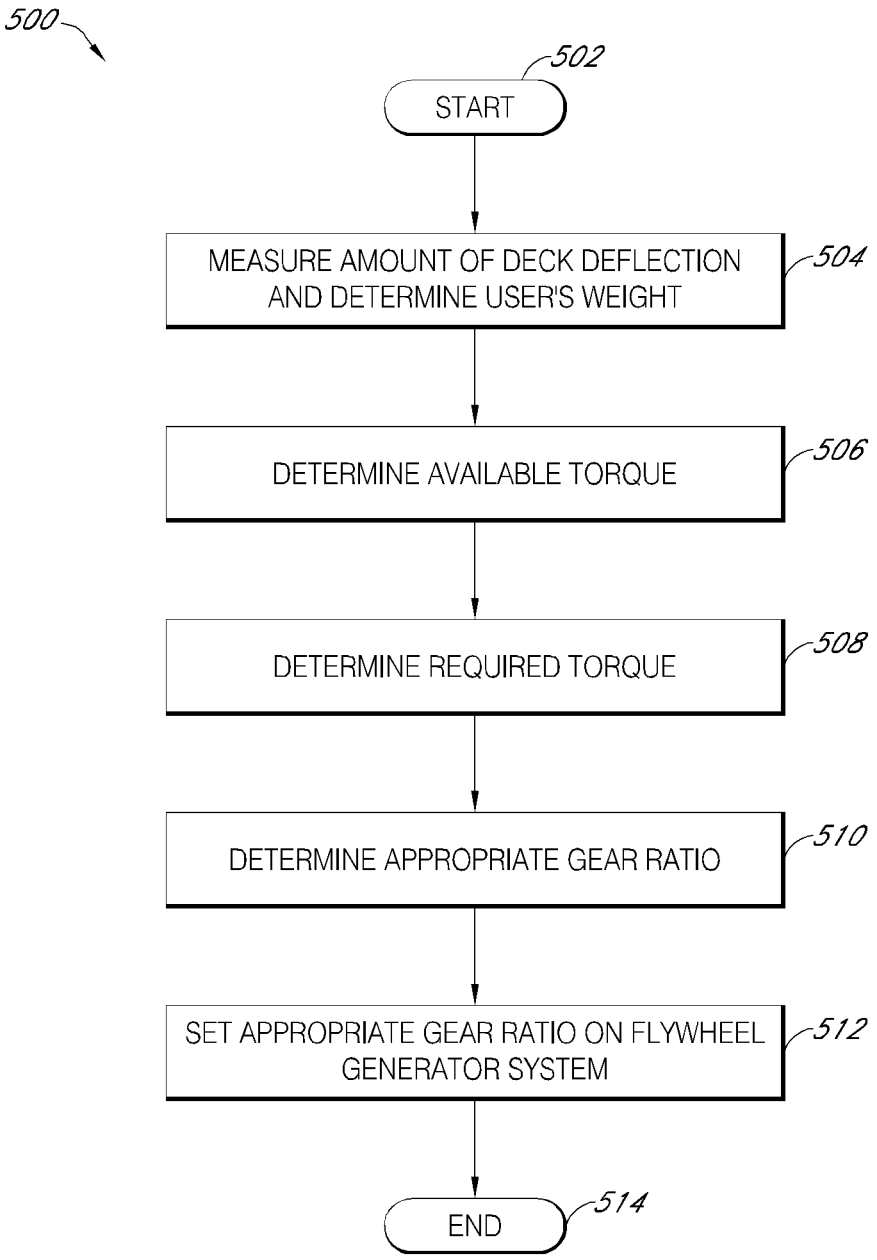
FIG. 13 is a flow chart illustrating an example of a process for controlling a flywheel generator and transmission system for a treadmill.

FIG. 13 illustrates one example of an embodiment of a process 500 to configure a cordless treadmill to have a smooth and consistent operation for users having different weights. Specifically, the process illustrated in FIG. 13 preferably allows users of different weights to smoothly start and maintain rotation of the treadmill belt. In some examples, the process 500 may be run on a processor, for example, processor 920 (FIG. 12), and on other components illustrated in FIG. 12 that are stored in memory 940 or that are incorporated in other hardware or software.

The process as illustrated in FIG. 13 determines the weight of a user, which may be determined by directly weighing the user, by measuring deck deflection of the treadmill, or through other means, and uses the determined weight to determine both the torque available to rotate the treadmill belt and the torque required to rotate the treadmill belt. The process 500 begins at start block 502 and transitions to block 504 wherein a processor, for example, processor 920, is instructed to measure an amount of deck deflection due to a user's weight and based on the amount of deck deflection, determine the user's weight. The process 500 then transitions to block 506, wherein the processor is instructed to determine the available torque based on settings of the treadmill such as the amount of incline and the user's weight and speed of movement on the treadmill. As noted above, the available torque is the variable amount of torque available due to the user's weight and treadmill settings such as the incline setting of the treadmill deck minus a predetermined friction of the treadmill components, such as the treadmill belt, front and rear rollers, and flywheel/gear system. Once the available torque has been determined, process 500 transitions to block 508. In block 508, the processor is instructed to determine the required torque, which is the amount of torque necessary to initiate rotation of the belt. After determining the required torque, the process 500 transitions to block 510 wherein the processor is instructed to determine the appropriate gear ratio for the flywheel generator system, based on the calculated available and required torque, to achieve smooth operation of the treadmill based on the user's weight. Once the appropriate gear ratio has been determined, the process 500 transitions to block 512 wherein the processor is instructed to set the appropriate gear ratio for the flywheel generator system such that smooth and efficient operation of the treadmill is achieved. The process 500 then transitions to block 514 and ends.

In some embodiments, setting the appropriate gear on the flywheel generator system may further include the stop of determining what braking or speed control method to use, such as resistive braking, eddy current braking, and/or frictional braking, as discussed above.

Automatic Stop

In some embodiments, the treadmill discussed above can include an automatic stop feature that can slow or stop the treadmill belt when a predetermined percentage of the body weight of the user has shifted a predetermined distance from an expected use position. The automatic stop feature works with at least one sensor, such as an infrared (IR) sensor or pressure sensor (or other sensor), and a control system, such as the variable impact absorption system discussed above. The automatic stop preferably provides an automatic safety mechanism for a treadmill belt that is not dependent on any user action, such as clipping on a safety leash.

For example, as a user walks or runs on the treadmill, typically the user's weight is evenly distributed between an area immediately left and right of the centerline of the treadmill belt, which corresponds to the expected path of the user's left and right feet. If, for example, at least 75% of the user's weight has shifted to a far right or far left edge of the treadmill, as determined by the sensor, the control system will act to stop the treadmill belt. Similarly, if more than a predetermined percentage of a user's weight is distributed too far forward or too far behind an expected use position, the control system will act to stop the treadmill belt. The predetermined percentage of the user's weight, or a predetermined weight shift percentage can be selected (e.g., by the user) to control the treadmill sensitivity to changes in user weight shift during use. In some embodiments, the predetermined percentage is 5%, 10%, 25%, 50%, 75% or 90%

Figure 21:
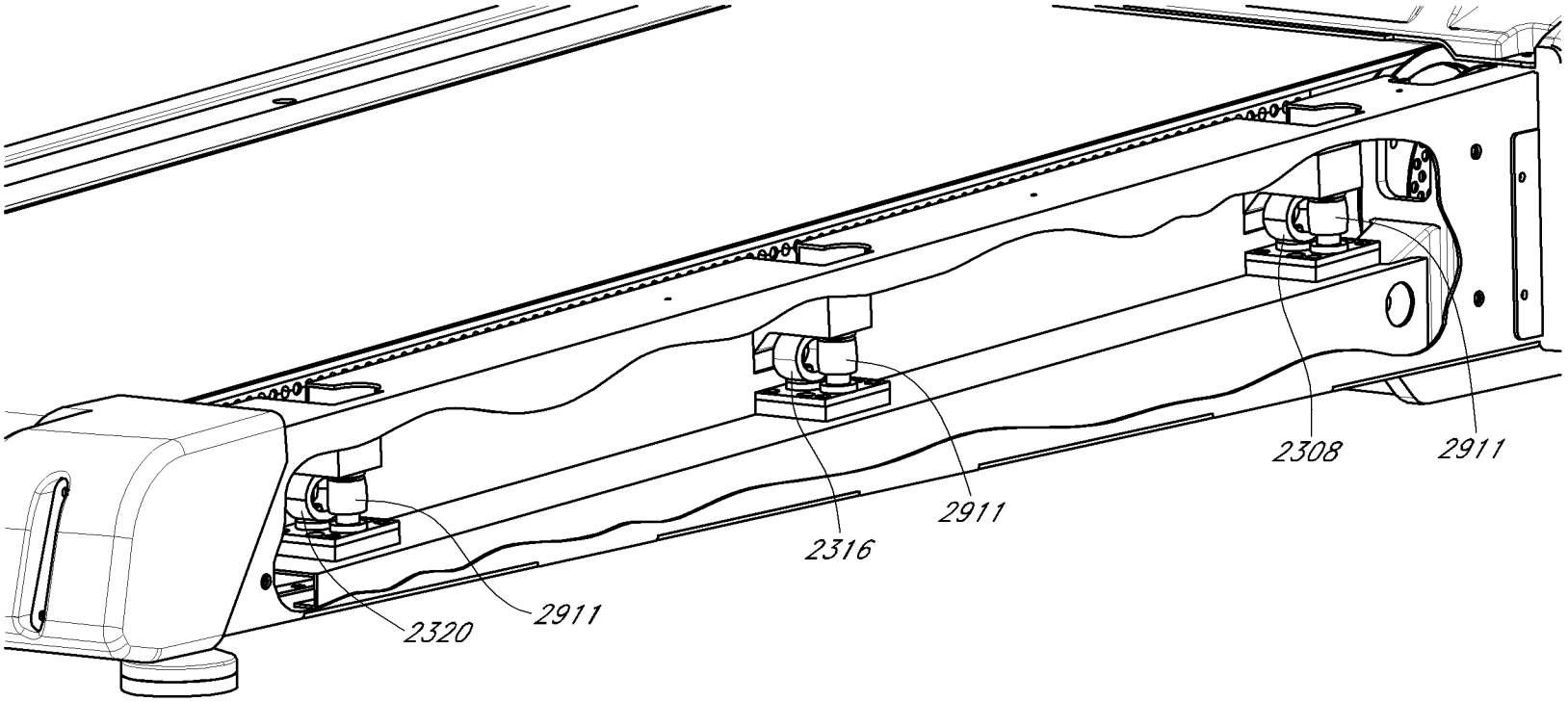
FIG. 21 illustrates the frame component of FIG. 20 including sensors and impact absorption components.

In some embodiments, the treadmill may include a sensor controlled emergency stopping system (SCESS). The SCESS uses sensors that may or may not be the same sensors used as part of the VIAS system discussed above to detect where the user's feet are on the deck with relationship to the running surface. The treadmill deck can be divided into a front portion 117 and a rear portion 119, as indicated by line 111 shown on FIG. 1A. During normal operation, as the user walks or runs on the treadmill, the user steps in the front portion 117 with one foot while the other foot lifts away from the rear portion 119. The user's weight then continuously alternates between the front portion 117 and the rear portion 119 as the user strides. For example, if a user steps with their right foot into the front portion 117, it is expected that the weight will transfer to the rear portion 119 as the treadmill belt rolls. If sensors, such as the sensors 911, shown as part of the VIAS system illustrated in FIG. 12, or the sensors 2911 shown in FIG. 21, detect that the user's next step is a step that is not in the expected area (that is, in some embodiments, in the front portion 117) or in an undesirable or unsafe area, a signal is sent to the control system to stop the treadmill belt. With continued reference to the above example, if the user's next step with their left foot is not in the front portion 117, a control signal can be sent to the control system to stop the treadmill belt. This can prevent a user from being thrown off the back of the treadmill due to failure of the belt to stop rotating when the user is falling or in an unexpected position on the treadmill belt. While a partial set of sensors 2911 is shown in FIG. 21 on one side of the treadmill, additional sensors 2911 may be located on the other side of the treadmill deck to provide additional indication of the position of the user on the treadmill.

Visual Feedback System

In some embodiments, a real-time, visual feedback system is provided with the treadmill described above or any other fitness machine. The visual feedback system can indicate, for example, impact or duration differences between the user's left leg and right leg, based on sensors (such as pressure or time sensors) located on or below the treadmill deck or cartridge.

The visual feedback system can display these values (e.g., pressure from each foot-impact on deck, time of contact between foot and deck, timing of right and left impact onto deck, changes in such vales, etc.) as a series of lights grading from red to yellow to green to yellow to red. A separate series of lights could be provided for each leg or arm. To indicate that the user has a limp, for example, the lights corresponding to sensors measuring the user's right side could light up in the first red area to indicate that the right leg has a step of a very short duration or very light pressure. The lights corresponding to sensors measuring the user's left side could light up in the second red area to indicate that the left leg has a step of a very long duration or very heavy pressure. Ideally, the user's steps would fall in the green area to indicate light and even impact and duration between the left and right legs.

This feedback system would provide information to aid the user in improving balance. However, the feedback system is not limited to use with a treadmill but could be used for any fitness machine to indicate strength disparities. The feedback system may also be used for physical therapy or to rehabilitate a person recovering from surgery or an injury.

Benefits and Advantages

A treadmill having one or more of the features discussed above has several advantages over a conventional, cordless treadmill. Most notably, a treadmill including the integrated flywheel generator system discussed above will have a smoother start and stop operation with decreased initial startup resistance as compared to a conventional cordless treadmill. Additionally, the treadmill will also generate electricity that may be used to power a control console, illuminate a visual feedback system, or for other purposes.

The treadmill as discussed above will also be easy to assemble due to the "drop in" frame design discussed above. The cartridge design including a pattern of staggered rollers centered on the treadmill running or walking surface desirably provides a smooth and consistent surface for the user. Constant contact between the belt and the rollers reduces energy losses and improves energy transfer to the electrical generator.

Increased safety and user features are desirably provided by the automatic stop and visual feedback systems, which may be particularly useful for use in a rehabilitation context.

Clarifications Regarding Terminology

Embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. In addition, the foregoing embodiments have been described at a level of detail to allow one of ordinary skill in the art to make and use the devices, systems, etc. described herein. A wide variety of variation is possible. Components, elements, and/or steps can be altered, added, removed, or rearranged. While certain embodiments have been explicitly described, other embodiments will become apparent to those of ordinary skill in the art based on this disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Depending on the embodiment, certain acts, events, or functions of any of the methods described herein can be performed in a different sequence, can be added, merged, or left out altogether (e.g., not all described acts or events are necessary for the practice of the method). Moreover, in certain embodiments, acts or events can be performed concurrently, e.g., through multi-threaded processing, interrupt processing, or multiple processors or processor cores, rather than sequentially.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A cordless treadmill, comprising:

a deck assembly comprising a frame, a belt system, an incline adjustment system, and a generator system; and a display assembly that supports an electronic display device above the deck assembly for displaying information to a user;

the belt system comprising a forward roller configured to roll about a forward axle that extends laterally from the forward roller into the frame, a rear roller configured to roll about a rear axle that extends laterally from the rear roller into the frame, a belt placed around the forward and rear rollers, and a plurality of support rollers that are smaller in diameter than the forward roller and are positioned between the forward and rear rollers to support the belt;

the incline adjustment system comprising a lift motor configured to cause a front end of the frame to change elevation with respect to a horizontal surface;

the generator system comprising a flywheel generator coupled to at least one of the forward or rear rollers and configured to generate electricity as a result of the at least one of the forward or rear rollers rotating with respect to the frame, wherein the flywheel generator is configured to generate power for use by the electronic display device and the lift motor;

wherein the deck assembly further comprises a weight sensor to detect a weight of a user, and wherein the incline adjustment system is configured to automatically adjust the elevation of the front end of the frame at least partially based on a detected weight of a user.

2. The cordless treadmill of claim 1, wherein the incline adjustment system further comprises:

a lever having a first end and a second end, the lever rotatably coupled to the frame at the first end, and the lever comprising one or more wheels at the second end; and a lift assist system functionally positioned between the frame and the lever, the lift assist system configured to apply a force to the lever in a direction that would tend to increase the elevation of the front end of the frame, to reduce an amount of electrical power required by the lift motor to increase the elevation of the front end of the frame.

3. The cordless treadmill of claim 2, wherein the lift assist system comprises one or more springs.

4. The cordless treadmill of claim 3, wherein each of the one or more springs are capable of lifting up to 150 pounds.

5. The cordless treadmill of claim 2, wherein the lift assist system comprises one or more gas springs.

6. The cordless treadmill of claim 2, wherein the lift assist system comprises a pair of gas springs, with one gas spring positioned adjacent a left side of the frame and another gas spring positioned adjacent a right side of the frame.

7. The cordless treadmill of claim 1, wherein the incline adjustment system comprises a linear actuator, the linear actuator comprising the lift motor.

8. The cordless treadmill of claim 1, wherein the incline adjustment system is manually controllable by a user.

9. The cordless treadmill of claim 1, wherein the incline adjustment system comprises an incline sensor, and the electronic display device is configured to display an indication of a present level of incline detected by the incline sensor.

10. The cordless treadmill of claim 1, further comprising a battery configured to store power generated by the flywheel generator, for powering at least one of the electronic display device or the lift motor.

11. The cordless treadmill of claim 1, wherein the electronic display device comprises an LED light display.

12. The cordless treadmill of claim 1, wherein the electronic display device comprises a video screen.

13. The cordless treadmill of claim 1, wherein the display assembly comprises a pedestal that supports the electronic display device above the deck assembly.

14. The cordless treadmill of claim 1, wherein the frame is adapted to place the belt of the belt system into tension as one or both of the forward or rear rollers is lowered into the frame.

15. The cordless treadmill of claim 14, wherein the frame comprise one or more arcuate slots adapted to receive the forward or rear axle, to place the belt of the belt system into tension as one or both of the forward or rear rollers is lowered into the frame.

16. The cordless treadmill of claim 1, wherein the plurality of support rollers are part of a roller cartridge.

17. The cordless treadmill of claim 16, wherein the roller cartridge comprises a plurality of columns of rollers positioned laterally adjacent to one another and positioned such that, when the belt is supported by the plurality of columns of rollers, the belt will form a substantially flat walking or running surface.

18. The cordless treadmill of claim 1, wherein the flywheel generator is coupled to the at least one of the forward or rear rollers through a transmission that enables a gear ratio between the belt system and the flywheel generator to be changed.

19. The cordless treadmill of claim 18, wherein the generator system is configured to adjust the gear ratio at least partially based on a detected weight of a user.

20. A cordless treadmill, comprising:

a deck assembly comprising a frame, a belt system, an incline adjustment system, and a generator system; and a display assembly that supports an electronic display device above the deck assembly for displaying information to a user;

the belt system comprising a forward roller configured to roll about a forward axle that extends laterally from the forward roller into the frame, a rear roller configured to roll about a rear axle that extends laterally from the rear roller into the frame, a belt placed around the forward and rear rollers, and a plurality of support rollers that are smaller in diameter than the forward roller and are positioned between the forward and rear rollers to support the belt;

the incline adjustment system comprising a lift motor configured to cause a front end of the frame to change elevation with respect to a horizontal surface;

the generator system comprising a flywheel generator coupled to at least one of the forward or rear rollers through a transmission that enables a gear ratio between the belt system and the flywheel generator to be changed, the flywheel generator configured to generate electricity as a result of the at least one of the forward or rear rollers rotating with respect to the frame, wherein the flywheel generator is configured to generate power for use by the electronic display device and the lift motor;

wherein the deck assembly further comprises a weight sensor to detect a weight of a user, and wherein the generator system is configured to adjust the gear ratio at least partially based on a detected weight of a user.

21. The cordless treadmill of claim 20, wherein the incline adjustment system further comprises:

a lever having a first end and a second end, the lever rotatably coupled to the frame at the first end, and the lever comprising one or more wheels at the second end; and a lift assist system functionally positioned between the frame and the lever, the lift assist system configured to apply a force to the lever in a direction that would tend to increase the elevation of the front end of the frame, to reduce an amount of electrical power required by the lift motor to increase the elevation of the front end of the frame.

22. The cordless treadmill of claim 20, further comprising a battery configured to store power generated by the flywheel generator, for powering at least one of the electronic display device or the lift motor.

23. The cordless treadmill of claim 20, wherein the frame is adapted to place the belt of the belt system into tension as one or both of the forward or rear rollers is lowered into the frame.

24. The cordless treadmill of claim 23, wherein the frame comprise one or more arcuate slots adapted to receive the forward or rear axle, to place the belt of the belt system into tension as one or both of the forward or rear rollers is lowered into the frame.

25. The cordless treadmill of claim 20, wherein the plurality of support rollers are part of a roller cartridge, wherein the roller cartridge comprises a plurality of columns of rollers positioned laterally adjacent to one another and positioned such that, when the belt is supported by the plurality of columns of rollers, the belt will form a substantially flat walking or running surface.

* * * * *